US006582487B2

(12) United States Patent
Larson et al.

(10) Patent No.: US 6,582,487 B2
(45) **Date of Patent: *Jun. 24, 2003**

(54) DISCRETE PARTICLES THAT INCLUDE A POLYMERIC MATERIAL AND ARTICLES FORMED THEREFROM

(75) Inventors: Eric G. Larson, Lake Elmo, MN (US); Don H. Kincaid, Hudson, WI (US); Ernest L. Thurber, Woodbury, MN (US); Ronald D. Provow, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/813,286

(22) Filed: Mar. 20, 2001

(65) Prior Publication Data

US 2003/0024170 A1 Feb. 6, 2003

(51) Int. Cl.[7] ..... B24D 3/02; B24D 3/28; B24D 18/00

(52) U.S. Cl. ..... 51/298; 51/307; 51/308; 51/309; 51/293; 51/295

(58) Field of Search ..... 51/298, 307, 308, 51/309, 293, 295

(56) References Cited

U.S. PATENT DOCUMENTS

| | | | | |
|---|---|---|---|---|
| 1,910,444 | A | | 5/1933 | Nicholson |
| 2,951,825 | A | | 9/1960 | Reinking et al. |
| 2,958,593 | A | | 11/1960 | Hoover et al. |
| 3,018,262 | A | | 1/1962 | Schroeder |
| 3,041,156 | A | | 6/1962 | Rowse et al. |
| 3,151,027 | A | | 9/1964 | Cooley et al. |
| 3,226,214 | A | | 12/1965 | Daniels et al. |
| 3,298,998 | A | | 1/1967 | McConnell et al. |
| 3,466,814 | A | | 9/1969 | Singer et al. |
| 3,615,303 | A | | 10/1971 | Singer et al. |
| 3,651,012 | A | | 3/1972 | Holub et al. |
| 3,689,346 | A | | 9/1972 | Rowland |
| 3,848,640 | A | | 11/1974 | Crawford et al. |
| 4,026,705 | A | | 5/1977 | Crivello et al. |
| 4,032,673 | A | | 6/1977 | Schroeter et al. |
| 4,047,903 | A | | 9/1977 | Hesse et al. |
| 4,069,054 | A | | 1/1978 | Smith |
| 4,107,116 | A | | 8/1978 | Riew et al. |
| 4,136,102 | A | | 1/1979 | Crivello |
| 4,173,476 | A | | 11/1979 | Smith et al. |
| 4,227,350 | A | | 10/1980 | Fitzer |
| 4,311,489 | A | | 1/1982 | Kressner |
| 4,314,827 | A | | 2/1982 | Leitheiser et al. |
| 4,318,766 | A | | 3/1982 | Smith |
| 4,393,021 | A | | 7/1983 | Eisenberg et al. |
| 4,396,657 | A | | 8/1983 | Ibrahim |
| 4,457,766 | A | | 7/1984 | Caul |
| 4,547,204 | A | | 10/1985 | Caul |
| 4,575,384 | A | | 3/1986 | Licht et al. |
| 4,588,419 | A | | 5/1986 | Caul et al. |
| 4,588,420 | A | * | 5/1986 | Charvat ..... 264/162 |
| 4,601,769 | A | | 7/1986 | DeHoff |
| 4,623,364 | A | | 11/1986 | Cottringer et al. |
| 4,652,275 | A | | 3/1987 | Bloecher et al. |
| 4,684,678 | A | | 8/1987 | Schultz et al. |
| 4,707,534 | A | | 11/1987 | Schultz |
| 4,735,632 | A | | 4/1988 | Oxman et al. |
| 4,744,802 | A | | 5/1988 | Schwabel |
| 4,751,138 | A | | 6/1988 | Tumey et al. |
| 4,770,671 | A | | 9/1988 | Monroe et al. |
| 4,773,599 | A | | 9/1988 | Lynch et al. |
| 4,799,939 | A | | 1/1989 | Bloecher et al. |
| 4,802,896 | A | | 2/1989 | Law et al. |
| 4,822,464 | A | | 4/1989 | Pocius |
| 4,836,832 | A | | 6/1989 | Tumey et al. |
| 4,871,376 | A | | 10/1989 | DeWald |
| 4,881,951 | A | | 11/1989 | Monroe et al. |
| 4,927,431 | A | | 5/1990 | Buchanan et al. |
| 4,952,342 | A | | 8/1990 | Drain et al. |
| 4,964,883 | A | | 10/1990 | Morris et al. |
| 4,983,672 | A | | 1/1991 | Almer et al. |
| 4,985,340 | A | | 1/1991 | Palazzotto et al. |

(List continued on next page.)

FOREIGN PATENT DOCUMENTS

| | | | |
|---|---|---|---|
| EP | 109851 A2 | | 5/1984 |
| EP | 306161 A2 | | 3/1989 |
| EP | 306162 A2 | | 3/1989 |
| GB | 964806 | | 7/1964 |
| GB | 994484 | | 6/1965 |
| JP | 63000351 | * | 1/1988 |
| WO | WO 98/10896 | | 3/1998 |

OTHER PUBLICATIONS

Derwent Acc. No. 1988–040455, Jan. 1998, abstract of JP 63000351.*

ASTM E399–90, "Standard Test Method for Plane–Strain Fracture Toughness of Metallic Materials," *Annual Book of ASTM Standards* pp.431–461 (1997).

*Encyclopedia of Polymer Science and Technology*, vol. 8, John Wiley & Sons, Inc., pp. 651–666 (1968). (No month).

Sherman et al., "Epoxy Resins," *Concise Encyclopedia of Chemical Technology*, vol. 24, 3rd Ed., Kirk–Othmer, Eds., John–Wiley & Sons, New York, Title Page, Publication Page, and pp. 431–433 1985 (No month).

*Primary Examiner*—Michael Marcheschi
(74) *Attorney, Agent, or Firm*—Bradford B. Wright

(57) ABSTRACT

The present invention provides discrete particles and methods of preparing the discrete particles. The discrete particles include a plurality of abrasive grits and a polymeric material that includes a reaction product of components including (a) an epoxy-functional material, (b) at least one of a cyclic anhydride or a diacid derived therefrom, and optionally (c) a polyfunctional (meth)acrylate. The invention also provides articles made from the discrete particles and methods of making such articles. Preferably, the articles are abrasive articles.

34 Claims, 4 Drawing Sheets

U.S. PATENT DOCUMENTS 4,997,461 A 3/1991 Markhoff-Matheny et al.
5,009,675 A 4/1991 Kunz et al.
5,011,508 A 4/1991 Wald et al.
5,042,991 A 8/1991 Kunz et al.
5,045,363 A 9/1991 Almer et al.
5,061,294 A 10/1991 Harmer et al.
5,090,968 A 2/1992 Pellow
5,137,542 A 8/1992 Buchanan et al.
5,152,917 A 10/1992 Pieper et al.
5,201,916 A 4/1993 Berg et al.
5,203,884 A 4/1993 Buchanan et al.
5,213,591 A 5/1993 Celikkaya et al.
5,215,863 A 6/1993 Nawata et al.
5,314,513 A 5/1994 Miller et al.
5,314,959 A 5/1994 Rolando et al.
5,360,462 A 11/1994 Harmer et al.
5,435,816 A 7/1995 Spurgeon et al.
5,436,063 A 7/1995 Follett et al.
5,451,446 A 9/1995 Kincaid et al.
5,496,387 A 3/1996 Culler
5,498,235 A 3/1996 Flower
5,500,273 A 3/1996 Holmes et al.
5,549,962 A 8/1996 Holmes et al.
5,571,297 A 11/1996 Swei et al.
5,580,647 A 12/1996 Larson et al.
5,667,842 A 9/1997 Larson et al.
5,681,217 A 10/1997 Hoopman et al.
5,704,952 A 1/1998 Law et al.
5,714,259 A 2/1998 Holmes et al.
5,833,724 A 11/1998 Wei et al.
5,855,632 A 1/1999 Stoetzel et al.
5,855,652 A 1/1999 Talley
5,863,306 A 1/1999 Wei et al.
5,863,847 A 1/1999 De Voe et al.
5,914,299 A * 6/1999 Harmer et al. ..... 51/295
5,922,784 A 7/1999 DeVoe et al.
5,946,991 A 9/1999 Hoopman
5,975,987 A 11/1999 Hoopman et al.
6,017,831 A 1/2000 Beardsley et al.
6,076,248 A 6/2000 Hoopman et al.
6,077,601 A 6/2000 DeVoe et al.
6,129,540 A 10/2000 Hoopman et al.
6,139,594 A 10/2000 Kincaid et al.

* cited by examiner

DISCRETE PARTICLES THAT INCLUDE A POLYMERIC MATERIAL AND ARTICLES FORMED THEREFROM

FIELD OF THE INVENTION

This invention relates to discrete particles that include a polymeric material, and articles formed from the discrete particles.

BACKGROUND

Conventional coated abrasive articles generally include a layer of abrasive grits adhered to a backing. Generally only a small fraction of the abrasive grits in this layer are actually utilized during the useful life of the coated abrasive article. A large proportion of the abrasive grits in this layer are wasted. Furthermore, the backing, one of the more expensive components of the coated abrasive article, must also be disposed of before it has worn out.

Many attempts have been made to distribute the abrasive grits on the backing in such a manner so that a higher percentage of abrasive grits are actually utilized, thereby extending the useful life of the coated abrasive article. By extending the life of the coated abrasive article, fewer belt or disc changes are required, thereby saving time and reducing labor costs. Merely depositing a thick layer of abrasive grits on the backing will not solve the problem, because grits lying below the topmost grits are not likely to be used.

Several methods whereby abrasive grits can be distributed in a coated abrasive article in such a way as to prolong the life of the article are known. One such way involves incorporating abrasive agglomerates in the abrasive article. Abrasive agglomerates consist of abrasive grits bonded together by means of a binder to form a mass. Abrasive agglomerates having random shapes and sizes are also known as well as precisely shaped abrasive agglomerates. Also known are precisely shaped particles of binder which are free of abrasive grits. There remains a need in the abrasive industry for thermosetting polymeric materials useful as binders to provide abrasive agglomerates with improved properties

SUMMARY OF THE INVENTION

In one aspect, the present invention provides a discrete particle including a polymeric material and a plurality of abrasive grits, wherein the polymeric material includes a reaction product of components including (a) an epoxy-functional material, and (b) at least one of a cyclic anhydride or a diacid derived therefrom. Preferably, the components further include (c) a polyfunctional (meth)acrylate.

In another aspect, the present invention provides a discrete particle including a plurality of abrasive grits and a polymeric material preparable by combining at least (a) an epoxy-functional material, and (b) at least one of a cyclic anhydride or a diacid derived therefrom. Preferably, the polymeric material is preparable by combining at least (a) an epoxy-functional material, (b) at least one of a cyclic anhydride or a diacid derived therefrom, and (c) a polyfunctional (meth)acrylate.

In another aspect, the present invention provides an abrasive article including a plurality of discrete particles that include a polymeric material including a reaction product of components including (a) an epoxy-functional material, and (b) at least one of a cyclic anhydride or a diacid derived therefrom. Preferably, the components further include (c) a polyfunctional (meth)acrylate. Preferably, at least a portion of the particles further include a plurality of abrasive grits. Preferably, the article further includes a backing and/or a nonwoven web attached to at least a portion of the particles.

In another aspect, the present invention provides an abrasive article including a plurality of particles including a polymeric material preparable by combining at least (a) an epoxy-functional material, and (b) at least one of a cyclic anhydride or a diacid derived therefrom. Preferably, the polymeric material is preparable by combining at least (a) an epoxy-functional material, (b) at least one of a cyclic anhydride or a diacid derived therefrom, and (c) a polyfunctional (meth)acrylate. Preferably, at least a portion of the particles further include a plurality of abrasive grits. Preferably, the article further includes a backing attached to at least a portion of the particles.

In another aspect, the present invention provides a method of preparing a discrete particle including combining at least (a) an epoxy-functional material, (b) at least one of a cyclic anhydride or a diacid derived therefrom, (c) a plurality of abrasive grits, and optionally (d) a polyfunctional (meth) acrylate to provide a composition; and at least partially curing at least a portion of the composition to provide a discrete particle. Preferably, the method includes irradiating at least a portion of the composition. Preferably, the method includes thermally curing at least a portion of the composition.

In one embodiment, the method of preparing a discrete particle includes providing a production tool having a three-dimensional body with one or more cavities in the three-dimensional body and introducing the composition into at least a portion of the one or more cavities. Preferably, the method includes partially curing at least a portion of the composition in at least a portion of the one or more cavities of the production tool. Preferably, the method includes removing the discrete particle from the cavity.

This invention makes it possible to design particles suitable for specific applications by varying the shape and composition of the particles.

Definitions

As used herein, "binder precursor" means any material that is conformable or can be made to be conformable by heat or pressure or both and that can be rendered non-conformable by means of radiation energy or thermal energy or both. A binder precursor may include the polymeric material according to the present invention and optional materials including abrasive grits, fillers, and grinding aids.

As used herein, "binder" refers to a solidified, handleable material. Preferably, the binder is formed from reaction of a binder precursor to provide a material (e.g., particles) that will not substantially flow or experience a substantial change in shape. The expression "binder" does not require that the binder precursor is fully reacted (e.g., polymerized or cured), only that it is sufficiently reacted, for example, to allow removal thereof from the production tool while the production tool continues to move, without leading to substantial change in shape of the binder.

It should be understood that where incorporation of an ingredient is specified, either a single ingredient or a combination or mixture of materials may be used as desired. Similarly, articles including "a," "an," and, "the" are meant to be interpreted as referring to the singular as well as the plural. It should also be understood that the specification of a value that includes the term "about" is meant to include both higher and lower values reasonably close to the specified value. For example, for some properties values either 10% above or 10% below the specified value are intended to be included by use of the term "about".

DETAILED DESCRIPTION OF PREFERRED EMBODIMENTS OF THE INVENTION

Figure 1:
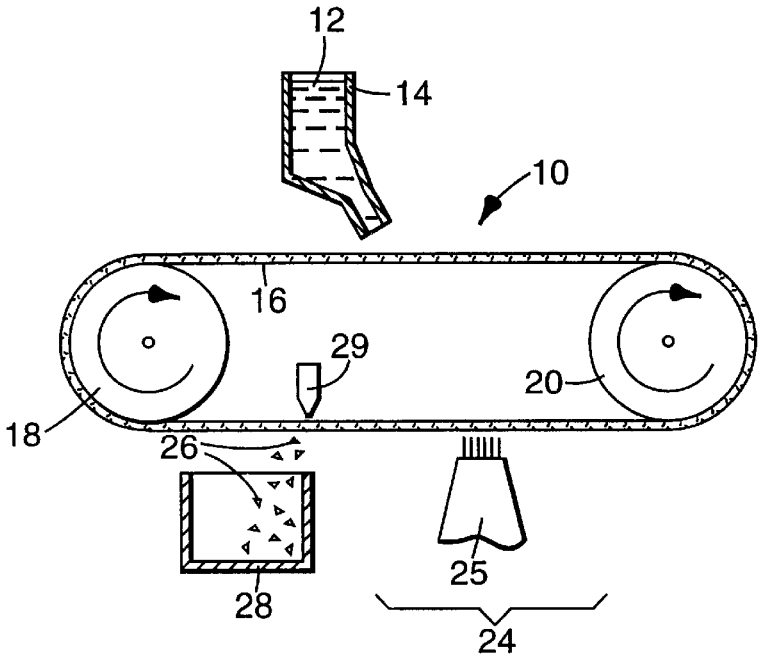
FIG. 1 is a schematic side view illustrating a method of carrying out a process for making exemplary particles according to the present invention.

Polymeric materials useful for making discrete particles according to the present invention include (1) a reaction product of components that include (a) an epoxy-functional material, (b) at least one of a cyclic anhydride or a diacid derived therefrom, and optionally (c) a polyfunctional (meth)acrylate; and/or (2) a polymeric material preparable by combining at least (a) an epoxy-functional material, (b) at least one of a cyclic anhydride or a diacid derived therefrom, and optionally (c) a polyfunctional (meth) acrylate. One or more polymeric materials may be used to make discrete particles according to the present invention. Abrasive articles having polymeric materials therein are also disclosed in copending U.S. patent application Ser. No. 09/813,368, filed on Mar. 20, 2001 and entitled "AN ABRASIVE ARTICLE HAVING PROJECTIONS ATTACHED TO A MAJOR SURFACE THEREOF" and U.S. patent application Ser. No. 09/812,174, filed on Mar. 20, 2001 and entitled "ABRASIVE ARTICLES HAVING A POLYMERIC MATERIAL," both of which are incorporated herein by reference in their entireties.

Preferably, the components include at least about 1% by weight epoxy-functional material, more preferably at least about 20% by weight epoxy-functional material, and most preferably at least about 30% by weight epoxy-functional material, based on the total weight of the combination of epoxy-functional material, cyclic anhydride and/or diacid derived therefrom, and optional polyfunctional (meth) acrylate. Preferably, the components include at most about 90% by weight epoxy-functional material, more preferably at most about 80% by weight epoxy-functional material, and most preferably at most about 60% by weight epoxy-functional material, based on the total weight of the combination of epoxy-functional material, cyclic anhydride and/or diacid derived therefrom, and optional polyfunctional (meth)acrylate.

Preferably, the components include at least about 0.1 mole of cyclic anhydride and/or diacid derived therefrom, more preferably at least about 0.2 mole cyclic anhydride and/or diacid derived therefrom, and most preferably at least about 0.3 mole cyclic anhydride and/or diacid derived therefrom, per equivalent of epoxy functionality in the epoxy-functional material. Preferably, the components include at most about 1.3 moles of cyclic anhydride and/or diacid derived therefrom, more preferably at most about 1.0 mole cyclic anhydride and/or diacid derived therefrom, and most preferably at most about 0.8 mole cyclic anhydride and/or diacid derived therefrom, per equivalent of epoxy functionality in the epoxy-functional material.

If the components used to make a polymeric material include polyfunctional (meth)acrylate, the components preferably include at least about 0.1% by weight polyfunctional (meth)acrylate, more preferably at least about 10% by weight polyfunctional (meth)acrylate, and most preferably at least about 20% by weight polyfunctional (meth)acrylate, based on the total weight of the combination of epoxy-functional material, cyclic anhydride and/or diacid derived therefrom, and polyfunctional (meth)acrylate. If the components used to make a polymeric material include polyfunctional (meth)acrylate, the components preferably include at most about 80% by weight polyfunctional (meth)acrylate, more preferably at most about 70% by weight polyfunctional (meth)acrylate, and most preferably at most about 60% by weight polyfunctional (meth)acrylate, based on the total weight of the combination of epoxy-functional material, cyclic anhydride and/or diacid derived therefrom, and polyfunctional (meth)acrylate.

Epoxy-Functional Materials

Examples of epoxy-functional materials useful for making polymeric materials useful for making discrete particles according to the present invention include octadecylene oxide, epichlorohydrin, styrene oxide, vinylcyclohexene dioxide (e.g., having the trade designation ERL-4206 from Union Carbide Corp., Danbury, Conn.), 3,4-epoxycyclohexyl-methyl-3,4-epoxycyclohexene carboxylate (e.g., having the trade designation ERL-4221 from Union Carbide Corp., Danbury, Conn.), 2-(3,4-epoxycyclohexyl-5,5-spiro-3,4-epoxy) cyclohexane-metadioxane (e.g., having the trade designation ERL-4234 from Union Carbide Corp., Danbury, Conn.), bis(3,4-epoxycyclohexyl) adipate (e.g., having the trade designation ERL-4299 from Union Carbide Corp., Danbury, Conn.), dipentene dioxide (e.g., having the trade designation ERL-4269 from Union Carbide Corp., Danbury, Conn.), epoxidized polybutadiene (e.g., having the trade designation OXIRON 2001 from FMC Corp., Pasanda, Tex.), silicone resin containing epoxy functionality, epoxy silanes (e.g., beta-3,4-epoxycyclohexylethyltrimethoxy silane and 3-glycidoxypropyltrimethoxy silane, available from Union Carbide, Danbury, Conn.), glycidol, glycidyl-methacrylate, diglycidyl ether of Bisphenol A (e.g., those available under the trade designations EPON 825, EPON 828, EPON 1004, and EPON 1001F from Resolution Performance Products, Houston, Tex., and DER-332 and DER-334 from Dow Chemical Co., Midland, Mich.), diglycidyl ether of Bisphenol F (e.g., having the trade designation ARALDITE GY281 from Vanitico, Inc., Brewster, N.Y.), flame retardant epoxy-functional materials (e.g., a brominated bisphenol type epoxy-functional material having the trade designation DER-542, available from Dow Chemical Co, Midland, Mich.), 1,4-butanediol diglycidyl ether (e.g., having the trade designation ARALDITE RD-2 from Vanitico, Inc., Brewster, N.Y.), hydrogenated bisphenol A-epichlorohydrin based epoxy-functional materials (e.g., having the trade designation EPONEX 1510 from Resolution Performance Products, Houston, Tex.), and polyglycidyl ether of phenol-formaldehyde novolak (e.g., having the trade designation DEN-431 and DEN-438 from Dow Chemical Co., Midland, Mich.), and triphenolmethane-epichlorohydrin based epoxy-functional material (e.g., having the trade designation TACTIX 742 from Vanitico, Inc., Brewster, N.Y.).

In certain embodiments according to the present invention 3,4-epoxycyclohexyl-methyl-3,4-epoxycyclohexene carboxylate (e.g., having the trade designation ERL-4221 from Union Carbide Corp., Danbury, Conn.) and epoxy-functional materials which are diglycidyl ethers of Bisphenol A (e.g., having the trade designations EPON 825, EPON 828, EPON 1001F, and EPON 1004 from Resolution Performance Products, Houston, Tex.) are particularly useful.

Cyclic Anhydrides and/or Diacids Derived Therefrom

Examples of cyclic anhydrides useful for making polymeric materials useful for making discrete particles according to the present invention include maleic anhydride, succinic anhydride, hexahydrophthalic anhydride, tetrahydrophthalic anhydride, dodecylsuccinic anhydride, phthalic anhydride, nadic anhydride, pyromellitic anhydride, and mixtures thereof. A cyclic anhydride, which is particularly useful in certain embodiments of the invention, is hexahydrophthalic anhydride, which is available, for example, from Buffalo Chemical Color Corporation, Buffalo, N.Y.

Cyclic anhydrides may also be hydrolyzed to yield diacids derived therefrom. The diacids, although not preferred, are also useful for making polymeric materials useful for making abrasive articles according to the present invention.

Optional Polyfunctional (Meth)Acrylates

The term "(meth)acrylate", as used herein, encompasses acrylates and methacrylates. "Polyfunctional (meth) acrylate" means that, on average, the (meth)acrylate moiety has greater than about 1.0 equivalent of (meth)acrylate functionality per molecule.

Polyfunctional (meth)acrylates useful for making polymeric materials useful for making discrete particles according to the present invention include, for example, ester compounds that are the reaction product of aliphatic or aromatic polyhydroxy compounds and (meth)acrylic acids. (Meth)acrylic acids are unsaturated carboxylic acids which include, for example, those represented by the following formula: $CH_2{=}C(R)C(O)OH$ where R is a hydrogen atom or a methyl group.

Polyfunctional (meth)acrylates can be monomers, oligomers, or polymers. For purposes of this invention, the term "monomer" means a molecule having a molecular weight less than about 400 Daltons and an inherent capability of forming chemical bonds with the same or other monomers in such manner that long chains (polymeric chains or macromolecules) are formed. For this application, the term "oligomer" means a molecule having 2 to 20 repeating units (e.g., dimer, trimer, tetramer, and so forth) having an inherent capability of forming chemical bonds with the same or other oligomers in such manner that longer polymeric chains can be formed therefrom. For this application, the term "polymer" means a molecule having greater than 20 repeating units having an inherent capability of forming chemical bonds with the same or other polymers in such manner that longer polymeric chains can be formed therefrom. The polyfunctional (meth)acrylate utilized according to the present invention may include, for example, polyfunctional (meth)acrylate monomers, polyfunctional (meth)acrylate oligomers, and polyfunctional (meth)acrylate polymers. For some embodiments, monomers and/or oligomers are particularly advantageous in that they tend to impart lower viscosities to the backing treatment composition than do polymers, which in some embodiments is advantageous for coating.

Useful polyfunctional (meth)acrylate monomers include, for example, ethylene glycol diacrylate, ethylene glycol dimethacrylate, hexanediol diacrylate, triethylene glycol diacrylate, trimethylolpropane triacrylate, ethoxylated trimethylolpropane triacrylate, glycerol triacrylate, pentaerthyitol triacrylate, pentaerythritol trimethacrylate, pentaerythritol tetraacrylate, pentaerythritol tetramethacrylate, and neopentylglycol diacrylate. For some embodiments, the polyfunctional (meth)acrylate monomer trimethylolpropane triacrylate can be particularly useful.

Useful polyfunctional (meth)acrylate monomers include, for example, trimethylolpropane triacrylate available, for example, under the trade designation SR351; ethoxylated trimethylolpropane triacrylate available, for example, under the trade designation SR454; pentaerythritol tetraacrylate available, for example, under the trade designation SR295; and neopentylglycol diacrylate available, for example, under the trade designation SR247; all available from Sartomer Co., Exton, Pa.

Useful polyfunctional (meth)acrylate oligomers include (meth)acrylated polyether and polyester oligomers. Examples of useful (meth)acrylated polyether oligomers include polyethylene glycol diacrylates available, for example, under the trade designations SR259 and SR 344 from Sartomer Co., Exton, Pa. (meth)acrylated polyester oligomers are available, for example, under the trade designations EBECRYL 657 and EBECRYL 830 from UCB Specialty Chemicals, Smyrna, Ga.

Other useful polyfunctional (meth)acrylate oligomers include (meth)acrylated epoxies, including diacrylated esters of epoxy-functional materials (e.g., diacrylated esters of bisphenol A epoxy-functional material) and (meth) acrylated urethanes. Useful (meth)acrylated epoxies include, for example, acrylated epoxies available under the trade designations EBECRYL 3500, EBECRYL 3600, EBECRYL 3700, and EBECRYL 3720 from UCB Specialty Chemicals, Smyrna, Ga. Useful (meth)acrylated urethanes include, for example, acrylated urethanes available under the trade designations EBECRYL 270, EBECRYL 1290, EBECRYL 8301, and EBECRYL 8804 from UCB Specialty Chemicals, Smyrna, Ga.

Polyfunctional (meth)acrylate monomers, oligomers, and polymers each generally react to form a network due to multiple functionalities available on each monomer, oligomer or polymer.

Optional Additives

Free Radical Initiators. The term "free radical initiator" as used herein refers to a material that is capable of generating a free radical species that may cause at least partial reaction of polyfunctional (meth)acrylate. Examples of useful free radical initiators include free radical photoinitiators and free radical thermal initiators.

A free radical initiator may be included as a component to aid in reaction of the polyfunctional (meth)acrylate, if present, although it should be understood that an electron beam source also could be used to generate free radicals. A free radical initiator is preferably included when it is desired to react the polyfunctional (meth)acrylate prior to reaction of the epoxy-functional material with cyclic anhydride and/or diacid derived therefrom.

Actinic radiation (e.g., ultraviolet light and visible light), unlike radiative and non-radiative thermal energy sources, generally does not cause the epoxy-functional material to react with cyclic anhydride and/or diacid derived therefrom. In addition, the use of actinic radiation generally causes more rapid reaction of the polyfunctional (meth)acrylate than thermal energy sources. Radiative thermal sources include infrared and microwave sources. Non-radiative thermal sources include air impingement ovens. The temperature at which both reaction of the polyfunctional (meth) acrylate and reaction of the epoxy-functional material with cyclic anhydride and/or diacid derived therefrom occurs can vary but for some embodiments they both may occur, for example, at a temperature greater than about 50° C., or greater than about 60° C.

Increasing amounts of the free radical initiator generally results in an accelerated reaction rate of the polyfunctional (meth)acrylate, if present. Increased amounts of free radical initiator can also, for some embodiments, result in reduced energy exposure requirements for reaction of the polyfunctional (meth)acrylate to occur. The amount of the free radical initiator is generally determined by the rate at which it is desired for the polyfunctional (meth)acrylate to react, the intensity of the energy source, and the thickness of the composition.

Preferably, the components include at least about 0.1% by weight free radical initiator and more preferably at least about 0.4% by weight free radical initiator, based on the total weight of the combination of epoxy-functional material, cyclic anhydride and/or diacid derived therefrom, and optional polyfunctional (meth)acrylate. Preferably, the components include at most about 5% by weight free radical initiator, more preferably at most about 4% by weight free radical initiator, and most preferably at most about 2% by weight free radical initiator, based on the total weight of the combination of epoxy-functional material, cyclic anhydride and/or diacid derived therefrom, and optional polyfunctional (meth)acrylate.

Free Radical Photoinitiators.

Examples of useful photoinitiators, which generate free radicals when exposed to ultraviolet light, include organic peroxides, azo compounds, quinones, benzophenones, nitroso compounds, acyl halides, hydrazones, mercapto compounds, pyrylium compounds, triacylimidazoles, acylphosphine oxides, bisimidazoles, chloroalkyltriazines, benzoin ethers, benzil ketals, thioxanthones, acetophenone derivatives, and mixtures thereof. An example of a useful free radical-generating initiator for use with ultraviolet light is 2,2-dimethoxy-2-phenylacetophenone initiator available, for example, under the trade designation IRGACURE 651 from Ciba Specialty Chemicals, Tarrytown, N.Y. Examples of photoinitiators that generate free radicals when exposed to visible radiation, are described in U.S. Pat. No. 4,735,632 (Oxman et al.).

Free Radical Thermal Initiators.

Free radical thermal initiators that may be utilized according to the present invention include azo, peroxide, persulfate, and redox initiators.

Suitable azo initiators include 2,2'-azobis(4-methoxy-2,4-dimethylvaleronitrile) (available under the trade designation VAZO 33); 2,2'-azobis(2-amidinopropane) dihydrochloride (available under the trade designation VAZO 50); 2,2'-azobis(2,4-dimethylvaleronitrile) (available under the trade designation VAZO 52); 2,2'-azobis(isobutyronitrile) (available under the trade designation VAZO 64); 2,2'-azobis-2-methylbutyronitrile (available under the trade designation VAZO 67); 1,1'-azobis(1-cyclohexanecarbonitrile) (available under the trade designation VAZO 88), all of which are available from E. I. Dupont deNemours and Company, Wilmington, Del., and 2,2'-azobis(methyl isobutyrate) (available under the trade designation V-601 from Wako Pure Chemical Industries, Ltd., Osaka, Japan).

Suitable peroxide initiators include benzoyl peroxide, acetyl peroxide, lauroyl peroxide, decanoyl peroxide, dicetyl peroxydicarbonate, di(4-t-butylcyclohexyl) peroxydicarbonate (available under the trade designation PERKADOX 16, from Akzo Chemicals, Inc., Chicago, Ill.), di(2-ethylhexyl) peroxydicarbonate, t-butylperoxypivalate (available under the trade designation LUPERSOL 11, from Lucidol Division., Atochem North America, Buffalo, N.Y.), t-butylperoxy-2-ethylhexanoate (available under the trade designation TRIGONOX 21-C50, from Akzo Chemicals, Inc., Chicago, Ill.), and dicumyl peroxide.

Suitable persulfate initiators include potassium persulfate, sodium persulfate, and ammonium persulfate.

Suitable redox (oxidation-reduction) initiators include combinations of persulfate initiators with reducing agents including sodium metabisulfite and sodium bisulfite; systems based on organic peroxides and tertiary amines (e.g., benzoyl peroxide plus dimethylaniline); and systems based on organic hydroperoxides and transition metals (e.g., cumene hydroperoxide plus cobalt naphthenate).

Curing Agents.

The components used in the present invention may further include a curing agent that promotes reaction of the epoxy-functional material with cyclic anhydride and/or diacid derived therefrom. The term "curing agent" as used herein refers to a material that increases the rate of reaction of the cyclic anhydride and/or diacid derived therefrom with the epoxy-functional material. The cyclic anhydride and/or diacid derived therefrom are excluded from the definition of "curing agent." Examples of suitable curing agents include, for example, catalysts and curatives. A "catalyst" is a curing agent that increases the rate of such a reaction but is not incorporated into the reaction product of the epoxy-functional material with cyclic anhydride and/or diacid derived therefrom. A "curative" is a curing agent that increases the rate of such a reaction and is incorporated into the reaction product of the epoxy-functional material with cyclic anhydride and/or diacid derived therefrom.

The reaction of the cyclic anhydride and/or diacid derived therefrom with epoxy-functional material generally results in ester linkages. The curing agent may be activated, for example, by exposure to ultraviolet or visible light radiation, by accelerated particles (e.g., electron beam radiation), or thermally (e.g., radiative and non-radiative sources).

If desired, the polyfunctional (meth)acrylate, if present, may be reacted prior to reaction of the epoxy-functional material with cyclic anhydride and/or diacid derived therefrom. A type of energy source and curing agent is preferably selected that would not cause the epoxy-functional material to react with cyclic anhydride and/or diacid derived therefrom simultaneously with the reaction of the polyfunctional (meth)acrylate. It is advantageous for certain embodiments to react the polyfunctional (meth)acrylate using ultraviolet or visible light radiation and a free radical photoinitiator followed by reaction of the epoxy-functional material with cyclic anhydride and/or diacid derived therefrom via a thermal energy source using a thermal curing agent. Epoxy-functional materials, cyclic anhydrides, and/or diacids derived therefrom are not free radically curable and thus would not generally be affected by the reaction of the polyfunctional (meth)acrylate via ultraviolet light radiation unless the light generates a significant amount of heat. Preferably, the components include at least about 0.1% by weight curing agent and more preferably at least about 0.4% by weight curing agent, based on the total weight of the combination of epoxy-functional material, cyclic anhydride and/or diacid derived therefrom, and optional polyfunctional (meth)acrylate. Preferably, the components include at most about 20% by weight curing agent, more preferably at most about 4% by weight curing agent, and most preferably at most about 3% by weight curing agent, based on the total weight of the combination of epoxy-functional material, cyclic anhydride and/or diacid derived therefrom, and optional polyfunctional (meth)acrylate. For some embodiments it may not be desired to react the polyfunctional (meth)acrylate prior to reaction of the epoxy-functional material with cyclic anhydride and/or diacid derived therefrom. A thermal curing agent, a thermal free radical initiator, and a thermal energy source may be used, for example, in such an embodiment.

Increasing amounts of the curing agent generally results in an accelerated reaction rate of the epoxy-functional material with cyclic anhydride and/or diacid derived therefrom. Increased amounts of curing agent generally also result in reduced energy exposure requirements for reaction of the epoxy-functional material with cyclic anhydride and/or diacid derived therefrom to occur and a shortened pot life at application temperatures. The amount of the curing agent is generally determined by the rate at which it is desired for the composition to cure, the intensity of the energy source, and the thickness of the composition.

Examples of useful curing agent catalysts include thermal catalysts and photocatalysts.

Thermal Catalyst Curing Agents.

Examples of useful thermal catalyst curing agents include those selected from the group consisting of Lewis acids and Lewis acid complexes inluding aluminum trichloride; aluminum tribromide; boron trifluoride; boron trichloride; antimony pentafluoride; titanium tetrafluoride; and boron trifluoride and boron trichloride complexes including, for example, $BF_3$-diethylamine and a $BCl_3$-amine complex available under the trade designation OMICURE BC-120 from CVC Specialty Chemicals, Inc., Maple Shade, N.J.

Additional useful thermal catalyst curing agents include aliphatic and aromatic tertiary amines including, for example, dimethylpropylamine, pyridine, dimethylaminopyridine, and dimethylbenzylamine; imidazoles including, for example, 2-ethylimidazole, and 2-ethyl-4-methylimidazole (available under the trade designation IMICURE EMI-2,4 from Air Products, Allentown, Pa.), hydrazides including, for example, aminodihydrazide; guanidines including, for example, tetramethyl guanidine; and dicyandiamide.

Photocatalyst Curing Agents.

The curing agent can, for example, be a cationic photocatalyst activated by actinic radiation (e.g., ultraviolet light and visible light).

Useful cationic photocatalysts are generally either protic or Lewis acids. Useful cationic photocatalysts include salts having onium cations and halogen-containing complex anions of a metal or metalloid (e.g., aryl sulfonium salts available under the trade designations CYRACURE UVI-6974 and CYRACURE UVI-6976 from Union Carbide Corporation, Danbury, Conn.). Other useful cationic photocatalysts include metallocene salts having organometallic complex cations and halogen-containing complex anions of a metal or metalloid which are further described in U.S. Pat. No. 4,751,138 (Tumey et al.). Another useful cationic catalyst is the combination of an organometallic salt and an onium salt described in U.S. Pat. No. 4,985,340 (Palazotto et al.), and European Pat. Publ. Nos. 306,161 (Palazotto et al.), published Mar. 8, 1989; and 306,162 (Palazotto et al.), published Mar. 8, 1989. Still other useful cationic photocatalysts include ionic salts of organometallic complexes in which the metals are selected from the elements of Periodic Groups, IVB, VB, VIB, VIIB, and VIII which are described in European Pat. Publ. No. 109,851 (Palazotto et al.), published May 30, 1984.

Curatives

Other useful curing agents, for certain embodiments, include aliphatic and aromatic amine curatives. Examples of aliphatic amine curatives include ethanolamine; 1,2-diamino-2-methyl-propane; 2,3-diamino-2-methyl-butane; 2,3-diamino-2-methyl-pentane; 2,4-diamino-2,6-dimethyloctane; and dibutylamine dioctylamine. Examples of aromatic amine curatives include o-phenylene diamine; 4,4-diaminodiphenyl sulfone; 3,3'-diaminodiphenyl sulfone; 4,4'-diaminodiphenylsulfide; 4,4'-diaminodiphenyl ketone; 4,4'-diaminodiphenyl ether; 4,4'-diaminodiphenyl methane; and 1,3-propanediol-bis(4-aminobenzoate). Aromatic amine curatives are advantageous in certain embodiments as they generally provide improved properties for the resulting polymeric material.

Increasing amounts of curing agent generally results in an accelerated reaction rate of the epoxy-functional material with cyclic anhydride and/or diacid derived therefrom. Increased amounts of curing agent generally also result in reduced energy exposure requirements for reaction of the epoxy-functional material with cyclic anhydride and/or diacid derived therefrom to occur and a shortened pot life at application temperatures. The amount of the curing agent is generally determined by the rate at which it is desired for the composition to cure, the intensity of the energy source, and the thickness of the composition.

As mentioned previously, a curing agent is an optional component. Preferably, the components include at least about 0.1% by weight curing agent and more preferably at least about 0.4% by weight curing agent, based on the total weight of the combination of epoxy-functional material, cyclic anhydride and/or diacid derived therefrom, and optional polyfunctional (meth)acrylate. Preferably, the components include at most about 20% by weight curing agent and more preferably at most about 10% by weight curing agent, based on the total weight of the combination of epoxy-functional material, cyclic anhydride and/or diacid derived therefrom, and optional polyfunctional (meth) acrylate.

Other Functional Additives.

The polymeric material according to the present invention may optionally include one or more additives in addition to the (1) reaction product of components that include (a) an epoxy-functional material, (b) at least one of a cyclic anhydride or a diacid derived therefrom, and optionally (c) a polyfunctional (meth)acrylate; and/or (2) polymeric material preparable by combining at least (a) an epoxy-functional material, (b) at least one of a cyclic anhydride or a diacid derived therefrom, and optionally (c) a polyfunctional (meth)acrylate. Useful additives include fillers (including grinding aids, for example), fibers, lubricants, wetting agents, surfactants, pigments, dyes, coupling agents, plasticizers, antistatic agents, and suspending agents. Compositions according to the present invention may also optionally include water or an organic solvent.

A filler, if included, preferably should not adversely affect the bonding characteristics of the polymeric material. Examples of fillers suitable for this invention include metal carbonates, including calcium carbonate (e.g., chalk, calcite, marl, travertine, marble, and limestone), calcium magnesium carbonate, sodium carbonate, and magnesium carbonate; silica, including amorphous silica, quartz, glass beads, glass bubbles, and glass fibers; silicates, including talc, clays (e.g., montmorillonite), feldspar, mica, calcium silicate, calcium metasilicate, sodium aluminosilicate, and sodium silicate; metal sulfates, including calcium sulfate, barium sulfate, sodium sulfate, aluminum sodium sulfate, aluminum sulfate; gypsum; vermiculite; wood pulp; aluminum trihydrate; metal oxides, including calcium oxide (lime), aluminum oxide, titanium dioxide; and metal sulfites, including calcium sulfite. If filler is present, the polymeric material preferably includes at least about 20% by weight filler based on the total weight of the polymeric material. If filler is present, the polymeric material preferably includes at most about 80% by weight filler based on the total weight of the polymeric material.

A grinding aid is generally a particulate material that has a significant effect on the chemical and physical processes of abrading, thereby resulting in improved performance. In particular, although not wanting to be bound by theory, it is believed that the grinding aid may (1) decrease the friction between the abrasive grits and the workpiece being abraded, (2) prevent the abrasive grits from "capping," i.e., prevent metal particles from becoming welded to the tops of the abrasive grits when the abrasive article is used on a metal workpiece, (3) decrease the interface temperature between the abrasive grits and the workpiece, or (4) decrease the grinding forces. In general, the addition of a grinding aid generally increases the useful life of the abrasive article. Grinding aids encompass a wide variety of different materials and can be inorganic or organic. Examples of useful grinding aids include waxes, organic halide compounds, halide salts, and metals and their alloys. The organic halide compounds will generally break down during abrading and release a halogen acid or a gaseous halide compound. Examples of such materials include chlorinated waxes, including tetrachloronaphthalene, pentachloronaphthalene, and polyvinyl chloride. Examples of halide salts include sodium chloride, potassium cryolite, sodium cryolite, ammonium cryolite, potassium tetrafluoroborate, sodium tetrafluoroborate, silicon fluorides, potassium chloride, and magnesium chloride. Examples of metals include tin, lead, bismuth, cobalt, antimony, cadmium, iron, and titanium. Other grinding aids include sulfur, organic sulfur compounds, graphite, and metallic sulfides. It is also within the scope of this invention to use a combination of different grinding aids and, in some instances, this may produce a synergistic effect. The above-mentioned examples of grinding aids is meant to be a representative showing of grinding aids, and it is not meant to encompass all grinding aids.

Examples of useful antistatic agents include graphite, carbon black, vanadium oxide, humectants, conductive polymers, and the like. These antistatic agents are disclosed in U.S. Pat. Nos. 5,061,294 (Harmer et al.); 5,137,542 (Buchanan et al.); and 5,203,884 (Buchanan et al.).

Useful coupling agents include, for example, silanes, titanates, and zircoaluminates. A useful silane coupling agent is 3-methacryloxypropyltrimethoxysilane, available, for example, under the trade designation A-174 from OSI Specialties, Inc. (Friendly, W.Va.). U.S. Pat. No. 4,871,376 (DeWald) describes reducing viscosity of resin/filler dispersions by utilizing a silane coupling agent.

If the particle contains abrasive grits, it is preferred that the particle be capable of breaking down during abrading. The selection and amount of the binder precursor, abrasive grits, and optional additives will influence the breakdown characteristics of the particle.

Combined Components

Compositions useful for making polymeric materials useful for making discrete particles according to the present invention may be prepared by combining at least an epoxy-functional material; at least one of a cyclic anhydride or a diacid derived therefrom; and optionally a polyfunctional (meth)acrylate.

In certain embodiments of the invention, the optional polyfunctional (meth)acrylate serves as a viscosity modifier to the composition after the polyfunctional (meth)acrylate has been at least partially reacted, which allows, for example, better control of the flow of the composition. For example, for certain embodiments, it is preferred to at least partially react the optional polyfunctional (meth)acrylate component prior to at least partially reacting the epoxy-functional material with cyclic anhydride and/or diacid derived therefrom. This at least partial reaction generally causes a large increase in viscosity of the composition. This generally limits the movement of the composition prior to at least partial reaction of the epoxy-functional material with cyclic anhydride and/or diacid derived therefrom. For certain embodiments, this is accomplished by subjecting the composition to an energy source that causes the optional polyfunctional (meth)acrylate to at least partially react, prior to at least partially reacting the epoxy-functional material with cyclic anhydride and/or diacid derived therefrom. Various energy sources and initiator combinations, discussed in more detail later herein, including, for example, ultraviolet light and e-beam radiation, can be selected to provide for certain embodiments at least partial reaction of the optional polyfunctional (meth)acrylate prior to at least partial reaction of the epoxy-functional material with cyclic anhydride and/or diacid derived therefrom. The method according to the present invention in certain embodiments allows for fewer composition applications, less energy for curing and lower raw material costs than conventional methods.

The percent solids of the composition utilized according to the present invention can vary. The percent solids of the composition is preferably at least about 50%, more preferably at least about 60%, even more preferably at least about 70%, even more preferably at least about 80%, even more preferably at least about 90%, and even more preferably at least about 95%. The percent solids of the composition is most preferably about 100%. A higher percent solids generally results in a faster curing composition. The term "percent solids" is readily understood and is capable of being determined by one skilled in the art.

Backing

Materials suitable for the backing according to the method according to the present invention include, for example, polymeric film, paper, cloth, metallic film, vulcanized fiber, nonwoven substrates, and treated versions thereof. For some embodiments, it may be advantageous for the backing be a polymeric film, for example, polyester film. For some embodiments, it may be advantageous for the backing to be substantially transparent to ultraviolet radiation. For some embodiments, it may be advantageous that the film be primed with a material, for example, polyethylene acrylic acid, to promote adhesion to the backing. The backing can optionally be laminated to another substrate after the abrasive article is formed. For example, a flexible backing can be laminated to a stiffer, more rigid substrate, for example, a metal plate.

Abrasive Grits

The term "abrasive grits" as used herein includes, for example, individual abrasive grits as well as multiple individual abrasive grits bonded together to form an abrasive agglomerate. Abrasive agglomerates are described, for example, in U.S. Pat. Nos. 4,311,489 (Kressner); 4,652,275 (Bloecher et al.); and 4,799,939 (Bloecher et al.).

In one particularly useful embodiment, the composition may contain abrasive grits. The polymeric material can function to bond the abrasive grits together to form an abrasive particle. The abrasive grits preferably have an average particle size of at least about 0.1 micrometer and more preferably at least about 1 micrometer. The abrasive grits preferably have an average particle size of at most about 1500 micrometers, more preferably at most about 1300 micrometers, and most preferably at most about 500 micrometers. The Moh's hardness of the abrasive grits can vary. The Moh's hardness of the abrasive grits is preferably at least about 5, more preferably at least about 6, even more preferably at least about 7, even more preferably at least about 8, and most preferably at least about 9. Examples of materials of such abrasive grits include aluminum oxide (e.g., fused aluminum oxide, ceramic aluminum oxide, white fused aluminum oxide, and heat treated aluminum oxide), silica, silicon carbide (e.g., green silicon carbide), alumina zirconia, zirconium oxide, diamond, ceria, cubic boron nitride, garnet, and tripoli. The ceramic aluminum oxide can be made, for example, according to a sol gel process, described, for example, in U.S. Pat. Nos. 4,314,827 (Leitheiser et al.); 4,744,802 (Schwabel); 4,623,364 (Cottringer et al.); 4,770,671 (Monroe et al.); 4,881,951 (Wood et al.); 5,011,508 (Wald et al.); and 5,213,591 (Celikkaya et al.). Ceramic aluminum oxides include, for example, alpha alumina and, optionally, a metal oxide modifier, including, for example, magnesia, zirconia, zinc oxide, nickel oxide, hafnia, yttria, silica, iron oxide, titania, lanthanum oxide, ceria, and neodynium oxide. The ceramic aluminum oxide may also optionally include a nucleating agent, including, for example, alpha alumina, iron oxide, iron oxide precursor, titania, and chromia. The ceramic aluminum oxide may also have a shape as described, for example, in U.S. Pat. Nos. 5,201,916 (Berg et al.) and 5,090,968 (Pellow).

The abrasive grit may also have a surface coating. A surface coating can improve the adhesion between the abrasive grit and the polymeric material and/or can alter the abrading characteristics of the abrasive grit. Such surface coatings are described in U.S. Pat. Nos. 5,011,508 (Wald et al.); 1,910,444 (Nicholson); 3,041,156 (Rowse et al.); 5,009,675 (Kunz et al.); 4,997,461 (Markhoff-Matheny et al.); 5,213,591 (Celikkaya et al.); and 5,042,991 (Kunz et al.). An abrasive grit may also contain a coupling agent on its surface, for example, a silane coupling agent.

The composition, may, for example, contain a single type of abrasive grit, two or more types of different abrasive grits, or at least one type of abrasive grit with at least one type of diluent material. Examples of materials for diluents include calcium carbonate, glass bubbles, glass beads, greystone, marble, gypsum, clay, $SiO_2$, $KBF_4$, $Na_2SiF_6$, cryolite, organic bubbles, organic beads, and the like.

The weight percentages of the abrasive grits and the polymeric material in the particle according to the present invention will depend on several factors, including the intended use of the abrasive article and the particle size and distribution of the abrasive grit. Preferably, the abrasive grits, if included, will be at least about 5% by weight and more preferably at least about 20% by weight, based on the total weight of the abrasive layer. Preferably, the abrasive grits, if included, will be at most about 95% by weight and more preferably at most about 75% by weight, based on the total weight of the abrasive layer. Preferably, the polymeric material will be at least about 5% by weight and more preferably at least about 25% by weight, based on the total weight of the abrasive layer. Preferably, the polymeric material will be at most about 95% by weight and more preferably at most about 80% by weight, based on the total weight of the abrasive layer.

Nonwoven Abrasive Articles

Nonwoven webs including open, lofty, three dimensional structures of fibers bonded to one another at their mutual contact points are used extensively in the manufacture of abrasive articles for cleaning, abrading, finishing and polishing applications on any of a variety of surfaces. Exemplary of such nonwoven articles are those described in U.S. Pat. No. 2,958,593 (Hoover et al.). Such nonwoven webs include a suitable fiber, for example, nylon, polyester, blends thereof, and the like, and are capable of withstanding temperatures at which impregnating resins and adhesive binders are generally cured. The fibers of the web are often tensilized and crimped but may also be continuous filaments formed by an extrusion process as described, for example, in U.S. Pat. No. 4,227,350 (Fitzer), for example. Nonwoven webs are readily formed on conventional equipment, for example, a Rando Webber machine.

Fine abrasive particles (defined herein as particles having a distribution of sizes wherein the median particle diameter in the distribution is about 60 micrometers or less) may be bonded to the fibers of a nonwoven web to provide abrasive articles suitable for use in any of a variety of abrasive applications, and such articles may be provided in the form of endless belts, discs, hand pads, densified or compressed wheels, floor polishing pads, and the like. A particularly appropriate use for articles including the aforementioned fine particles is in the automotive aftermarket industry, where the abrasive particles are employed to "scuff" or lightly abrade automobile body panels in preparation for painting. In these applications, the abrasive article is applied to a previously painted surface. During the application, the abrasive particles in the article scratch the surface to reduce the surface gloss to a "haze." Although the commercial success of available abrasive articles has been impressive, it is desirable to further improve the performance of certain abrasive articles especially in applications in the automotive aftermarket, for example.

In the manufacture of these articles, a nonwoven web is prepared, as mentioned. The web is reinforced, for example, by the application of a prebond resin to bond the fibers at their mutual contact points. Additional resin layers may subsequently be applied to the prebonded web. A make coat precursor is applied over the fibers of the prebonded web and the make coat precursor is at least partially cured. A size coat precursor may be applied over the make coat precursor and both the make coat precursor and the size coat precursor are sufficiently hardened in a known manner (e.g., by heat curing). Fine abrasive particles, when included in the construction of the article, are conventionally applied to the fibers in a slurry with the make coat precursor.

Discrete Particles

The particles according to the present invention preferably have a particle size of at least about 1 micrometer, more preferably at least about 250 micrometers, and most preferably at least about 500 micrometers. The particles according to the present invention preferably have a particle size of at most about 5000 micrometers, more preferably at most about 2500 micrometers, and most preferably at most about 1500 micrometers.

The particles according to the present invention may preferably have a predetermined shape as disclosed, for example, in U.S. Pat. Nos. 6,076,248 (Hoopman et al.), 5,152,917 (Pieper et al.), and 5,489,235 (Gagliardi et al.). Conversely the particle may have a random shape as disclosed in, for example, copending U.S. patent application Ser. No. 09/688,444, filed Oct. 16, 2000 and entitled "Method of Making an Abrasive Agglomerate Particle"; U.S. patent application Ser. No. 09/688,484, filed Oct. 16, 2000 and entitled "An Abrasive Article"; and U.S. patent application Ser. No. 09/688,486, filed Oct. 16, 2000 and entitled "Method of Making an Agglomerate Particle." However, particles according to the present invention include (1) a reaction product of components that include (a) an epoxy-functional material, (b) at least one of a cyclic anhydride or a diacid derived therefrom, and optionally (c) a polyfunctional (meth)acrylate; and/or (2) a polymeric material preparable by combining at least (a) an epoxy-functional material, (b) at least one of a cyclic anhydride or a diacid derived therefrom, and optionally (c) a polyfunctional (meth)acrylate. Examples of shaped abrasive agglomerates and methods of making may be found, for example, in U.S. Pat. No. 5,500,273 (Holmes et al.) and PCT Patent Publ. No. WO 98/10896 published Mar. 19, 1998. Examples of abrasive agglomerates may be found in U.S. Pat. Nos. 4,393,021 (Eisenberg et al.); 4,799,939 (Bloecher et al.); and 5,093,311 (Bloecher et al.).

It is within the scope of this invention to provide a coating on the outer surface of a particle of the invention. The coating can be continuous or discontinuous. Examples of coatings suitable for the particles include metal coatings, metal oxide coatings, carbide coatings, nitride coatings, boride coatings, inorganic carbon coatings, diamond coatings, diamond like carbon coatings, and the like. Alternatively an organic coating can be present on the surface of the particle. The organic coating may further include fillers, coupling agents, antistatic agents, grinding aids, and the like.

The selection and amount of the coating will depend upon the desired properties of the particle. For instance, some coatings will result in a retroreflective particle. Alternatively, some coatings will improve adhesion of the particle to other materials or a substrate.

Production Tools

Discrete particles according to the present invention can be made, for example, using a production tool. The production tool is preferably a three-dimensional body having at least one continuous surface. Preferably at least one opening, more preferably a plurality of openings, are present in the continuous surface. Each opening preferably provides access to a cavity formed in the three-dimensional body. As used in this context, the term "continuous" means characterized by uninterrupted extension in space; the openings and cavities are features in the continuous surface, but they do not break the surface into a plurality of individual surfaces. The production tool is preferably in the form of a web, a belt, e.g., an endless belt, a sheet, a coating roll, or a sleeve mounted on a coating roll. Preferably the production tool is one that allows continuous operations, including, for example, an endless belt or a cylindrical coating roll that rotates about an axis. Preferably, a cylindrical coating roll has a diameter of about 25 cm to about 45 cm and is constructed of a rigid material. Useful materials for a production tool include, for example, polyolefin polymers (e.g., polypropylene) and metals, (e.g., nickel). The production tool can also be formed from a ceramic material, for example.

A production tool made of metal may preferably be fabricated, for example, by engraving, photolithography, hobbing, etching, knurling, assembling a plurality of metal parts machined in the desired configuration, die punching, or by electroforming. A frequently used method for preparing a metal production tool or master tool is diamond turning. These techniques are further described in the *Encyclopedia of Polymer Science and Technology,* Vol. 8, John Wiley & Sons, Inc., 651–65 (1968) and U.S. Pat. No. 3,689,346, (Rowland) col. 7, lines 30 to 55. The production tool may also contain a release coating to permit easier removal of the particles from the cavities and to minimize wear of the production tool. Examples of such release coatings include hard coatings including metal carbides, metal nitrides, metal borides, diamond, or diamond-like carbon. It is also within the scope of this invention to use a heated production tool, which is generally made from metal. A heated tool may allow easier processing, more rapid curing, and easier release of the particles from the tool.

In some instances, a polymeric production tool can be replicated from an original master tool. This is most frequently done when the production tool is in the form of a belt or web. One general advantage of polymeric tools over metal tools is cost. Another general advantage of polymeric tools is the capability of allowing radiation to pass from the radiation source through the production tool and into the composition. A polymeric production tool can be prepared, for example, by coating a molten thermoplastic resin, for example, polypropylene, onto the master tool. The molten resin can then be quenched to give a thermoplastic replica of the master tool. This polymeric replica can then be utilized as the production tool. Additionally, the surface of the production tool may contain a release coating, for example, a silicone-based material or fluorochemical-based material, to improve the releasability of the particles from the production tool. It is also within the scope of this invention to incorporate a release agent into the polymer from which the production tool is formed. Suitable release agents include silicone-based materials and fluorochemical-based materials. It is within the scope of this invention to prepare production tools from polymers that exhibit good release characteristics. Such a polymer is described in U.S. Pat. No. 5,314,959 (Rolando et al.). That document describes a fluorochemical graft copolymer including a base polymer including polymerized units derived from monomers having terminal olefinic double bonds, having a moiety including a fluoroaliphatic group grafted thereto. The grafted fluoroaliphatic group is generally derived from a fluorochemical olefin including a fluoroaliphatic group and a polymerizable double bond.

The fluoroaliphatic group of the fluorochemical olefin is generally bonded to the polymerizable double bond through a linking group. Such fluorochemical olefins can be represented, for example, by the following formula:

$$(R_f)_aQ(CR{=}CH_2)_b$$

wherein R represents hydrogen, trifluoromethyl, or straight-chain or branched-chain alkyl group including 1 to 4 carbon atoms;

a represents an integer from 1 to 10;

b represents an integer from 1 to 6;

Q represents an (a+b)-valent linking group that does not substantially interfere with free radical polymerization; and $R_f$ represents a fluoroaliphatic group including a fully fluorinated terminal group including at least seven fluorine atoms.

The metal master tool can be made by the same methods that can be used to make metal production tools. Other methods of preparing production tools are described, for example, in U.S. Pat. No. 5,435,816 (Spurgeon et al.).

Polymeric tools are described in U.S. Pat. No. 5,435,816 (Spurgeon et al.). If the production tool is made from a thermoplastic material, the conditions of the method should generally be set such that any heat generated in the curing zone does not adversely affect the production tool.

As mentioned previously, preferably at least one continuous surface of the production tool contains at least one cavity, more preferably a plurality of cavities. The binder precursor will generally acquire a shape corresponding to the shape of the cavities. A cavity can have any shape including, for example, an irregular shape of a geometric shape (e.g., pyramid, prism, cylinder, and cone). Pyramids generally have bases having three or four sides. The geometric shapes can be truncated versions of the foregoing. It is also within the scope of this invention that a given production tool may contain a variety of cavities of different shapes or cavities of different sizes or both. In the case of a web or belt, the cavity can extend completely through the production tool. The cavities can abutt or have land areas between them. The sides of the cavities may have a slope associated them to allow easier removal of the binder from the production tool.

There may, however, be minor imperfections in the particles that are introduced when the particles are removed from the cavities. If the composition is not sufficiently cured in the cavities, the composition will generally flow, and the resulting shape will generally not correspond to the shape of the cavities. This lack of correspondence may not result in the predetermined shape of the particle.

Apparatuses and Methods

The following apparatuses and methods discussed below are primarily directed to the preparation of particles according to the present invention, which are generally regular in shape. Other known methods of making regularly shaped particles can be adopted by substituting the polymeric material or composition described herein for the binder of any other known shaped particles to make particles according to the present invention. Irregularly shaped particles can be made wherein the polymeric material according to the present invention is substituted for the known binder.

Figure 9:
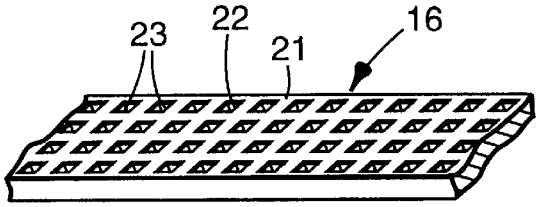
FIG. 9 is a perspective view of a segment of the production tool of FIG. 1. The segment illustrated in FIG. 9 is substantially similar to segments of the production tools of FIGS. 1, 2, and 3.

FIG. 1 illustrates an apparatus capable of carrying out a method to make exemplary embodiments of particles according to the present invention. In apparatus 10, composition 12 is fed by gravity from a hopper 14 onto a production tool 16, which is in the form of an endless belt. The belt 16 travels over two rolls 18, 20, at least one of which is power driven. FIG. 9 is a perspective view of a segment of the production tool 16. As can be seen in FIG. 9, the production tool 16 is a three-dimensional body having a continuous surface 21 containing an openings 22 that provides access to a cavities 23 in the three-dimensional body. At least a portion of cavities 23 are filled by composition 12 illustrated in FIG. 1. Referring again to FIG. 1, composition 12 then travels through a curing zone 24 where it is exposed to an energy source 25 to at least partially cure the composition 12 to form a solidified, handleable binder 26. Particles of binder material 26 are removed from the production tool 16 and collected in a container 28. External means 29, e.g., ultrasonic energy, can be used to help release the particles of binder material 26 from the production tool 16. Debris left in the production tool 16 is generally cleaned away before any fresh composition 12 is fed to the production tool 16.

Figure 2:
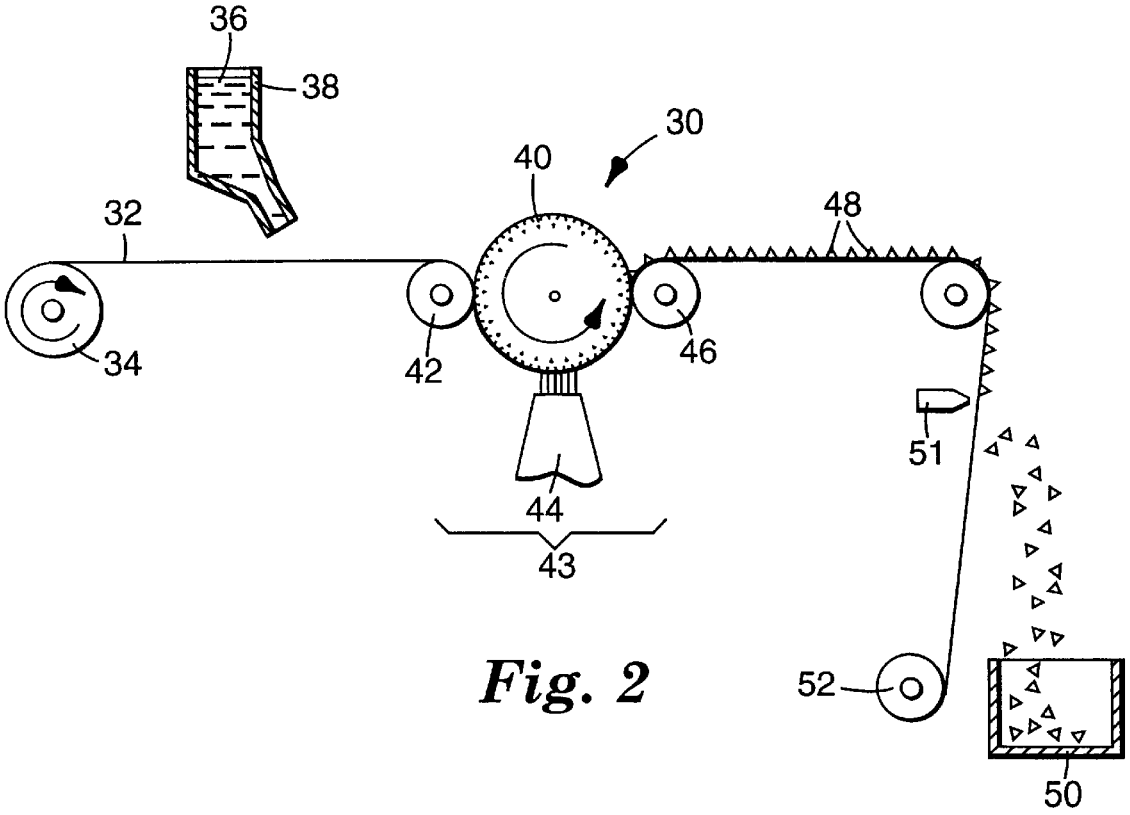
FIG. 2 is a schematic side view illustrating another method of carrying out a process for making exemplary particles according to the present invention.

FIG. 2 illustrates another variation of apparatus capable of making exemplary embodiments of particles according to the present invention. Apparatus 30 includes a carrier web 32 which is fed from an unwind station 34. Unwind station 34 is in the form of a roll. The carrier web 32 can be made of materials including, for example, paper, cloth, polymeric film (e.g., polyester film), nonwoven web, vulcanized fiber, and treated versions thereof. In FIG. 2, the carrier web 32 is substantially transparent to desired wavelengths of actinic radiation. A composition 36 is fed by gravity from a hopper 38 onto a major surface of the carrier web 32. The major surface of the carrier web 32 containing the composition 36 is forced against the surface of a production tool 40 by means of a nip roll 42. The surface of the production tool 40 that contacts the carrier web is curved, but it is otherwise identical to that of the segment of the production tool shown in FIG. 9. The nip roll 42 also aids in forcing the composition 36 into the cavities of the production tool 40. The composition 36 then travels through a curing zone 43 where it is exposed to an energy source 44 to at least partially cure the composition 36 to form a solidified, handleable binder 48. Next, the carrier web 32 containing the solidified, handleable binder 48 is passed over a nip roll 46. There must be sufficient adhesion between the carrier web 32 and the solidified, handleable binder 48 in order to allow for subsequent removal of the binder particles 48 from the cavities of the production tool 40. The particles of binder material 48 are removed from the carrier web 32 and collected in a container 50. External means 51, e.g., ultrasonic energy, can be used to help release the particles 48 from the carrier web 32. The carrier web 32 is then recovered at rewind station 52 so that it can be reused. Rewind station 52 is in the form of a roll.

Removal of the particles of binder material 48 from the carrier web 32 can be carried out efficiently by an alternative method. In this alternative method, the carrier web 32 can contain a thin, water-soluble layer (not shown in FIG. 2) on the major surface thereof that receives the composition 36 from the hopper 38. The water-soluble layer will come into contact with the composition 36. After the composition 36 is at least partially cured, the combination of carrier web 32 and solidified, handleable binder 48 is subjected to a source of water (not shown in FIG. 2), whereby the water dissolves the water-soluble layer on the carrier web 32, thereby bringing about separation of the particles of binder material 48 from the carrier web 32. An example of a water-soluble layer useful for this variation is a layer of a water-soluble polymer, e.g., polyvinyl alcohol, polyvinyl pyrrolidone, and cellulose derivatives.

Figure 3:
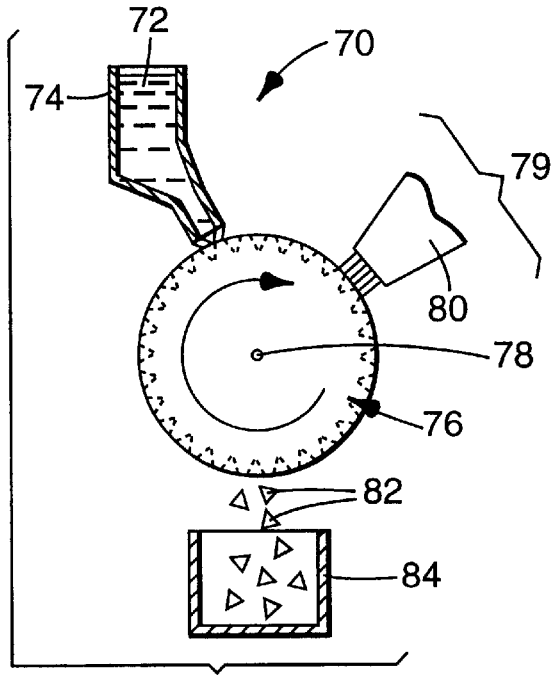
FIG. 3 is a schematic side view illustrating yet another method of carrying out a process for making exemplary particles according to the present invention.

FIG. 3 illustrates another variation of an apparatus 70 capable of making exemplary embodiments of particles according to the present invention. In apparatus 70, composition 72 is knife coated from a hopper 74 onto a production tool 76. The production tool 76 is in the form of a cylindrical drum and has an axis 78. The continuous surface of the production tool 76 is curved, but it is otherwise identical to the segment of the production tool shown in FIG. 9. As the production tool 76 rotates about the axis 78, the composition 72 travels through a curing zone 79 where it is exposed to an energy source 80 to at least partially cure the composition 72 to form a solidified, handleable binder 82. Next, the particles of solidified, handleable binder 82 resulting from the curing step of the process are removed from the production tool 76 and collected in a hopper 84. Removal is generally carried out by mechanical means, e.g., a water jet. Generally any debris remaining in the production tool 76 be removed before any fresh composition 72 is introduced. Debris removal can be accomplished by a brush, an air jet, or any other conventional technique. Although not shown in FIG. 3, additional means can be used to aid in removing the particles of binder 82 from the production tool 76.

To form a mixture including a binder precursor and other materials (e.g., abrasive grits), the components can be mixed together by any conventional technique, including, for example high shear mixing, air stirring, or tumbling. A vacuum can be used on the mixture during mixing to minimize entrapment of air.

The composition can be introduced to the cavities of the production tool by a dispensing means that utilizes any conventional technique, including, for example, gravity feeding, pumping, die coating, and vacuum drop die coating. The composition can also be introduced to the cavities of the production tool by transfer via a carrier web. The composition can be subjected to ultrasonic energy during the mixing step or immediately prior to the coating step in order to lower the viscosity of the composition.

Although the composition generally only needs to fill a portion of a cavity when a production tool is used in making particles according to the present invention, the composition preferably completely fills the cavities in the surface of the production tool, so that the resulting particles will contain few voids or imperfections. These imperfections cause the shape of the particles to depart from the generally desired shape. Additionally, when a binder material is removed from the production tool, an edge may break off, thereby creating an imperfection and detracting from the shape. Preferably, care is taken throughout the process to minimize such imperfections. Sometimes, however, voids or imperfections are desirable, because they create porosity in the resultant particles, thereby causing the particles to have greater erodibility. For some embodiments, it is desirable that the composition not extend substantially beyond the openings of the cavities of the production tool.

For some embodiments, it is desirable that the composition be heated prior to being introduced to the production tool, preferably at a temperature of about 30° C. to about 90° C., more preferably about 30° C. to about 50° C. When the composition is heated, its viscosity is generally reduced with the result that it can flow more readily into the cavities of the production tool.

The step following the introduction of the composition into the cavities of the production tool preferably involves at least partially curing the composition by exposing it to radiation energy and/or thermal energy while it is present in the cavities of the production tool. Alternatively, the composition can be at least partially cured while it is present in the cavities of the production tool, and then post-cured after the binder is removed from the cavities of the production tool. The post-cure step can be omitted. The degree of cure is preferably sufficient such that the resulting solidified, handleable binder will retain its shape upon removal from the production tool.

The composition is preferably capable of being cured by radiation energy and/or thermal energy. Sources of radiation energy include, for example, electron beam energy, ultraviolet light, visible light, and laser light.

Electron beam radiation, which is also known as ionizing radiation, can preferably be used at an energy level of about 0.1 Mrad to about 20 Mrad and more preferably at an energy level of about 1 Mrad to about 10 Mrad. Ultraviolet radiation preferably refers to non-particulate radiation having a wavelength of about 200 nanometers to about 400 nanometers and more preferably about 250 nanometers to about 400 nanometers. The dosage of radiation preferably is about 50 $mJ/cm^2$ to about 1000 $mJ/cm^2$, more preferably about 100 $mJ/cm^2$ to about 400 $mJ/cm^2$. Examples of lamp sources that are suitable for providing this amount of dosage preferably provide about 100 Watts/2.54 cm to about 600 Watts/2.54 cm, more preferably about 300 Watts/2.54 cm to about 600 Watts/2.54 cm. Visible radiation preferably refers to non-particulate radiation having a wavelength of about 400 nanometers to about 800 nanometers, more preferably about 400 nanometers to about 550 nanometers. The amount of radiation energy needed to sufficiently cure the composition depends upon a number of factors including, for example, the size of the particles being made, and the chemical identity of the composition. Conditions for thermal cure preferably is about 50° C. to about 200° C. and for a time of about fractions of minutes to about thousands of minutes. The actual amount of heat required is dependent on the chemistry of the binder precursor.

If ultraviolet or visible light is utilized, a photoinitiator is frequently included in the mixture. Upon being exposed to ultraviolet or visible light, the photoinitiator generates a free radical source or a cationic source. This free radical source or cationic source then initiates the polymerization of the binder precursor. In free radical processes, a photoinitiator is optional when a source of electron beam energy is utilized.

After being at least partially cured, the resulting solidified, handleable binder will preferably not strongly adhere to the surface of the production tool. In either case, at this point, the solidified binder precursor forms particles that may be removed from the production tool.

There are several alternative methods for removing binder particles from the production tool. In one method, binder particles are transferred directly from the production tool to a collector, e.g., a hopper. In this method, if the production tool is made of a polymeric material, the binder can be removed from the cavities by methods including, for example, ultrasonic energy, a vacuum, an air knife, and other conventional mechanical means. If the production tool is made of metal, the binder can be removed from the cavities, for example, by means of a water jet or air jet. If the production tool has cavities that extend completely through the production tool, e.g., if the production tool is a belt having perforations extending completely therethrough, the binder can be removed by methods including, for example, ultrasonic energy, mechanical force, water jet, air jet, and other mechanical means, regardless of the material of construction of the production tool.

In another method, the binder particles can be transferred indirectly from the production tool to a collector. In one embodiment, the binder particle can be transferred from the production tool to a smooth roll. The binder particle generally exhibits greater adhesion to the smooth roll than to the production tool. The transferred binder particles can then be removed from the smooth roll by means of skiving, vacuum, water jet, air jet, or other mechanical means. In one particular embodiment, the binder particles can be transferred from the production tool to a major surface of a carrier web. The binder particles generally exhibit greater adhesion to the major surface of the carrier web than to the production tool. The major surface of the carrier web to which the binder is transferred can bear a layer of material that is soluble in water or an organic solvent, for example. The binder can generally be easily removed from the carrier web by merely dissolving the material that forms the soluble layer. In addition, mechanical means, e.g., skiving, vacuum, or ultrasound, can be used to remove the binder. Ultrasonic energy can be applied, for example, directly over a major surface of the web or off to a side of a major surface of the web. In another embodiment, the major surface of the carrier web can have a primer thereon. Examples of primers suitable for the carrier web include ethylene acrylic acid copolymer, poly(vinylidene chloride), crosslinked hexanediol diacrylate, aziridine materials, and the like. The binder will preferentially adhere to the primed carrier web. The binder can then be removed from the primed carrier web by mechanical means, e.g., skiving, vacuum, or ultrasound.

After the binder is removed from the production tool, either by direct or indirect means, it is then converted into particles. In one mode of conversion, the binder is released from the production tool in the form of particles. A given particle will generally have a shape that is essentially the shape of the portion of the cavity of the production tool in which the particle was at least partially cured. An advantage of this mode is that the particles are generally already of the proper grade or of the proper particle size distribution for subsequent use, e.g., incorporation into an abrasive article.

In a second mode of conversion, the binder is released from the production tool as a sheet of material including binder material particles interconnected by a thin layer of binder material. The binder is then broken or crushed along the thin interconnecting portions to form discrete particles.

In a variation, the production tool can be a drum or a belt that rotates about an axis. When the production tool rotates about an axis, the process can be conducted continuously. When the production tool is stationary, the process is conducted batch-wise. A continuous process is usually more efficient and economical than the batch-wise processes of the prior art.

Although the composition is preferably at least partially cured, it is also within the scope of the present invention to cure the composition after removal from the production tool. For example, the composition may be treated as described in U.S. Pat. Nos. 5,833,724 (Wei et al.) and 5,863,306 (Wei et al.) to increase the viscosity of the composition and render it plastic but non-flowing. Such an exemplary procedure is described as follows.

Prior to contacting the production tool, the viscosity of the composition may be modified to limit the flow that would tend to occur at viscosities at which the composition is conventionally deposited. However, it is not necessary that the viscosity of the whole of the composition be increased. It is preferably sufficient that the outer exposed portion quickly attain a higher viscosity, which can then act as a skin to retain the shape of the production tool, even when the inner portion retains a relatively lower viscosity for a longer period.

Viscosity modification of at least the surface layers can be achieved, for example, by incorporating a volatile solvent into the composition. The solvent can be rapidly lost when the composition is deposited on the carrier web. Solvent removal may be assisted by an increase in ambient temperature or by a localized blast of hot gas.

Temperature can also affect the viscosity. However, increased temperature may also cause accelerated curing in the case of thermally curable systems. Another option may be to decrease the temperature of the structure such that viscosity is increased. The temperature could be decreased, for example, by passing a substrate having the composition thereon under a chilled roll and/or under a cold gas flow.

In addition to adjusting viscosity by changing temperature or removing a liquid, it may also be possible to change the viscosity by increasing the solids loading. In general, it is sufficient that the surface layer achieve a viscosity sufficient to hold a subsequently imparted shape. Thus, applying a finely divided powder on the surface of the structure may act to form a localized skin of increased viscosity on the structure, causing it to retain an imposed shape until cure renders the shape permanent.

Characteristics of the Abrasive Articles

This invention also provides abrasive articles containing particles according to the present invention. These abrasive articles can be, for example, bonded abrasive articles, coated abrasive articles, or nonwoven abrasive articles.

Figure 7:
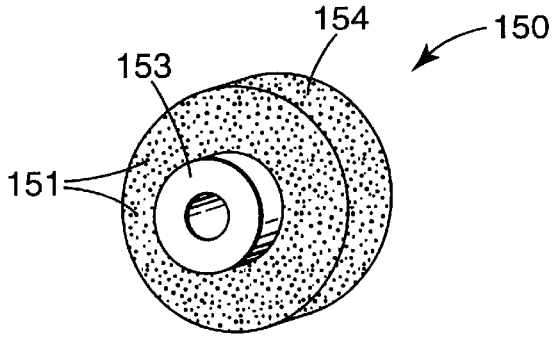
FIG. 7 is a schematic view of an embodiment of a bonded abrasive article according to the present invention that includes exemplary particles according to the present invention.

For a bonded abrasive article, particles according to the present invention are bonded together by a bonding medium to form a shaped mass, e.g., a wheel, a cut-off wheel. Bonded abrasive articles are generally made by a molding process. FIG. 7 is a schematic view of a bonded abrasive article 150 of the invention. Particles according to the present invention 151 including binder and abrasive grits are bonded together via bonding medium 154. A core 153 is inserted in the interior of article 150.

Figure 8:
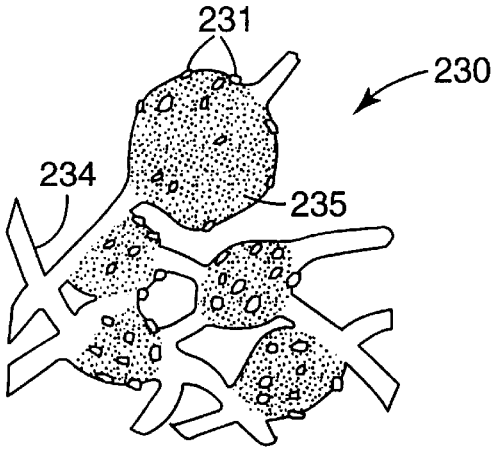
FIG. 8 is a schematic view of an embodiment of a nonwoven abrasive article according to the present invention that includes exemplary particles according to the present invention.

A nonwoven abrasive article generally includes an open, porous, fibrous, nonwoven substrate having a plurality of abrasive particles bonded into the substrate. This type of nonwoven abrasive article is described, for example, in U.S. Pat. No. 2,958,593 (Hoover et al.). For a nonwoven abrasive article, particles according to the present invention can be attached to a nonwoven fibrous substrate. FIG. 8 is a schematic view of a nonwoven abrasive article 230 of the invention. Particles according to the present invention 231 including polymeric material and abrasive grits are attached to the fibers 234 of a nonwoven web via bonding medium 235.

For a coated abrasive article, particles according to the present invention can be attached by a bonding medium to a backing. Backings suitable for preparing coated abrasive articles include, for example, polymeric film, primed polymeric film, cloth, paper, vulcanized fiber, polymeric foam, nonwovens, and treated versions thereof.

Figure 4:
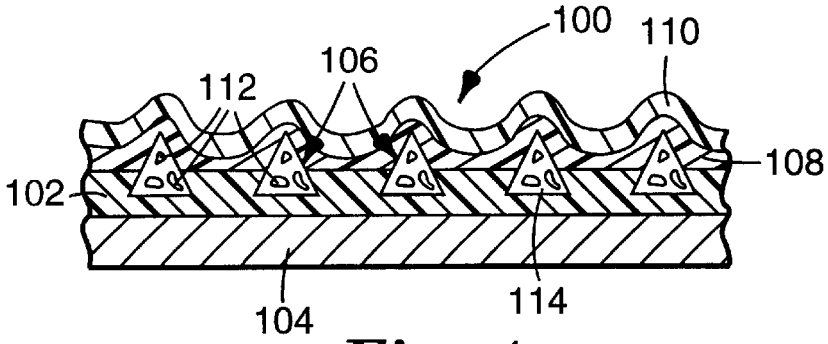
FIG. 4 is a schematic side view in elevation of an abrasive article that utilizes exemplary particles according to the present invention.

Referring to FIG. 4, an abrasive article according to the present invention 100 contains two coatings for binding the abrasive particles 106 to the backing 104. Coating 102, commonly referred to as a make coat, is applied over backing 104 and bonds particles according to the present invention 106 which are regular in shape to backing 104. Coating 108, commonly referred to as a size coat, is applied over particles 106 and reinforces particles 106. There may also be a third coating 110, commonly referred to as a supersize coat, applied over the size coat 108. The particles 106 include a plurality of abrasive grits 112 and a binder 114. The abrasive particles can be applied to the backing by conventional techniques, e.g., by drop coating or by electrostatic coating. The particles 106 are oriented in a nonrandom manner in FIG. 4.

Figure 5:
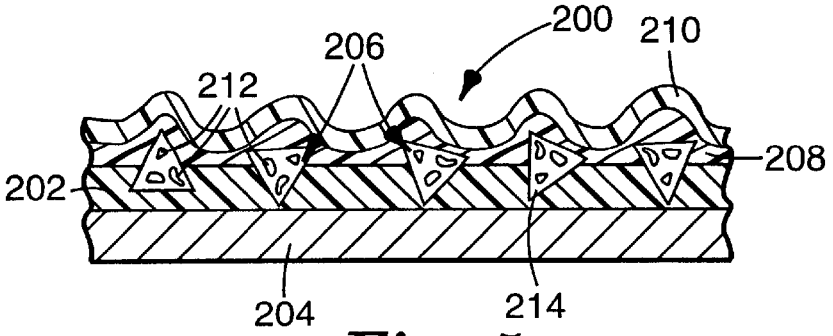
FIG. 5 is a schematic side view in elevation of another abrasive article that utilizes exemplary particles according to the present invention.

Referring to FIG. 5 an abrasive article according to the present invention 200 contains two coatings for binding abrasive particles 206 to the backing 204. Make coat 202 is applied over backing 204 and bonds particles according to the present invention 206, which are regular in shape, to backing 204. Size coat 208 is applied over particles 206 and reinforces particles 206. Supersize coat 210 is applied over the size coat 208. The particles 206 include a plurality of abrasive grits 212 and a binder 214. The particles 206, as shown, are oriented in a random manner.

Figure 6:
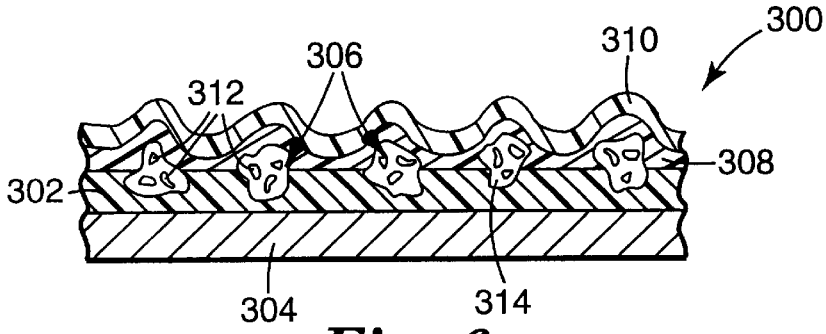
FIG. 6 is a schematic side view in elevation of yet another abrasive article that utilizes exemplary particles according to the present invention.

Referring to FIG. 6 an abrasive article according to the present invention 300 contains two coatings for binding the abrasive particles 306 to the backing 304. Make coat 302 is applied over backing 304 and bonds particles according to the present invention 306, which are irregular in shape, to backing 304. Size coat 308, is applied over particles 306 and reinforces particles 306. Supersize coat 310, is applied over the size coat 308. The particles 306 include a plurality of abrasive grits 312 and a binder 314. The particles 306, as shown, are oriented in a random manner.

The particles according to the present invention can be coated or placed randomly onto the backing. Alternatively, for example, the particles can be oriented on the backing in a specified direction. In the case of discrete particles having the shapes of pyramids, cones, and prisms (e.g., triangular-shaped prisms), the particles can be oriented, for example, so that their bases point toward the backing and their vertexes point away from the backing, as in FIG. 4, or they can be oriented, for example, so that their vertexes point toward the backing and their bases point away from the backing, as do four of the particles in FIG. 5.

An abrasive article can be made, for example, according to the following procedure. A backing having a front surface and a back surface is provided. The front surface of the backing is coated with a first curable bonding medium including a resinous adhesive; then the particles according to the present invention and, optionally, the individual abrasive grits are coated or applied into the first curable bonding medium. The discrete abrasive particles and optional abrasive grits can be drop coated or electrostatic coated. The first curable bonding medium is then solidified or cured to form a cured resinous adhesive. Optionally, a second curable bonding medium including a resinous adhesive can be applied over the particles and then solidified or cured to form a cured resinous adhesive. The second curable bonding medium can be applied prior to or subsequent to solidification or curing of the first curable bonding medium.

As mentioned previously, in another aspect of this invention, the particles according to the present invention may not contain any abrasive grits. These particles that are free of abrasive grits can be used, for example, in an abrasive article (e.g., a coated abrasive article, a bonded abrasive article, and a nonwoven abrasive article), which do not contain any abrasive grit. Such articles are generally intended for polishing applications rather than grinding applications. Alternatively grit free particles according to the present invention may be used in combination with grit-containing particles according to the present invention in an abrasive article according to the present invention. Alternatively, the grit free particles according to the present invention may be used in combination with looser abrasive grit in an abrasive article according to the present invention. Other combinations of particles according to the present invention with other optional materials are possible. As a specific example, an abrasive article may include a backing, and bonded to the backing via a make coat, are abrasive grits and particles according to the present invention that are free of abrasive grits.

As illustrated in FIG. 4, a second coat 108 of cured resinous adhesive (size coat) is over the abrasive grits and particles (size coat).

The material for bonding particles according to the present invention to a substrate or together generally includes a cured resinous adhesive and optional additives. Examples of resinous adhesives suitable for this invention include phenolic resins, aminoplast resins, urethane resins, epoxy-functional materials, (meth)acrylate resins, (meth) acrylated isocyanurate resins, urea-formaldehyde resins, isocyanurate resins, (meth)acrylated urethane resins, vinyl ethers, and (meth)acrylated epoxy-functional materials. The optional additives include fillers (including grinding aids), fibers, lubricants, wetting agents, surfactants, pigments, dyes, coupling agents, plasticizers, and suspending agents. Examples of fillers include talc, calcium carbonate, calcium metasilicate, and silica. The amounts of these materials are selected to provide the properties desired.

Abrasive articles according to the present invention may optionally further include, for example, conventional abrasive agglomerates and individual abrasive grits. These conventional abrasive agglomerates and/or abrasive grit may be regular or irregular in shape. Conventional abrasive agglomerates are further described, for example, in U.S. Pat. Nos. 4,311,489 (Kressner); 4,652,275 (Bloecher et al.); and 4,799,939 (Bloecher et al.). Individual abrasive grits can also be selected to have a desired shape. Examples of individual abrasive grits include fused aluminum oxide, ceramic aluminum oxide, heat treated aluminum oxide, silicon carbide, alumina zirconia, diamond, ceria, cubic boron nitride, and garnet. Preferably, about 10 percent by weight, more preferably at least about 50 percent by weight, and most preferably at least about 70 percent by weight, of the abrasive material should be the particles according to the present invention based on the total weight of the abrasive particles. In an embodiment of an abrasive article, individual abrasive grits can be disposed over the particles. In another embodiment, the individual abrasive grits can be disposed underneath the particles according to the invention. In another embodiment, individual abrasive grit can be disposed, for example, between two particles according to the invention.

Uses of the Abrasive Articles

Particles according to the present invention are useful, for example, for wet grinding, dry grinding, and/or sanding applications. Methods for abrading with abrasive particles according to the present invention range from snagging (i.e., high pressure high stock removal) to polishing (e.g., polishing medical implants with abrasive belts), wherein the latter is generally done with finer grades (e.g., less ANSI 220 and finer) of abrasive particles. The abrasive particle may also be used in precision abrading applications, for example, grinding camshafts with vitrified bonded wheels. The size of the abrasive particles used for a particular abrading application will be apparent to those skilled in the art.

Abrading with abrasive particles according to the present invention may be done dry or wet. For wet abrading, the liquid may be introduced supplied in the form of a light mist to complete flood. Examples of commonly used liquids include: water, water-soluble oil, organic lubricant, and emulsions. The liquid may serve to reduce the heat associated with abrading and/or act as a lubricant. The liquid may contain minor amounts of additives including, for example, bactericide, antifoaming agents, and the like.

Abrasive particles according to the present invention may be used to abrade workpieces including, for example, aluminum metal, carbon steels, mild steels, tool steels, stainless steel, hardened steel, titanium, glass, ceramics, wood, wood-like materials, paint, painted surfaces, organic coated surfaces, and the like. The applied force during abrading generally ranges from about 1 to about 100 kilograms.

The present invention is illustrated by the following examples. It is to be understood that the particular examples, materials, amounts, and procedures are to be interpreted broadly in accordance with the scope and spirit of the invention as set forth herein.

EXAMPLES

The following non-limiting examples will further illustrate the invention. All parts, percentages, ratios, etc, in the examples are by weight unless indicated otherwise. The materials employed to produce the various examples are identified in Table 1.

TABLE 1

| Materials and Sources | |
|---|---|
| acrylate monomer 1 | pentaerythritol triacrylate SR444, Sartomer Company, West Chester, PA |
| resole phenolic resin | resole phenolic resin, 74% in water, potassium hydroxide catalyzed |
| acrylate monomer 2 | polyethylene glycol 200 diacrylate SR259, Sartomer Company, West Chester, PA. |
| silicone antifoam | DC-163, Dow Corning Company, Midland, Michigan |
| Feldspar | K-T Feldspar Corporation, Spruce Pine, NC |
| photoinitiator | Phenylbis(2,4,6-trimethylbenzoyl) phsophine oxide IRGACURE 819, Ciba Specialty Chemical Corporation, Tarrytown, NY |
| wetting agent | Phosphate polyester DISPERBYK 111, BYK-Chemie, Wesel, Germany |
| $SiO_2$ | AEROSIL OX50, Degussa-Huls Ltd., Cheshire, UK |
| acrylate monomer 3 | Trimethylol propane triacrylate (TMPTA) |
| epoxy-functional material | bisphenol A diglycidyl ether EPON 825, Resolution Performance Products, Houston, TX. |
| cyclic anhydride | 2:1 mixture of hexahydrophthalic anhydride and phthalic anhydride |
| catalyst 1 | triaryl sulfonium hexafluoroantimonate 50% in propylene carbonate SAR-CAT CD1010, Sartomer Company, West Chester, PA |
| abrasive particles 1 | Grade P120 heat treated aluminum oxide. Washington Mills Minerals Corporation, Niagra Falls, NY |
| abrasive particles 2 | Ceramic aluminum oxide Grade P100 321 CUBITRON, Minnesota Mining and Manufacturing Company, St. Paul, MN |
| Wollastonite | $CaO \cdot SiO_2$ WOLLASTOCOAT, NYCO Minerals Inc., Wilsboro NY |
| catalyst 2 | 2-ethyl, 4-methylimidazole, IMICURE EMI-2,4, Air Products Allentown, PA. |
| hexahydrophthalic anhydride | 72639, Buffalo Color Corporation. Buffalo, New York. |

TABLE 2

Premix Formulations

| Component | Premix 1 (g) | Premix 2 (g) | Premix 3 (g) | Premix 4 (g) | Premix 5 (g) | Premix 6 (g) | Premix 7 (g) | Premix 8 (g) |
|---|---|---|---|---|---|---|---|---|
| acrylate monomer 1 | 736 | — | — | — | 736 | — | — | — |
| Resole phenolic resin | 654 | — | — | — | 654 | — | — | — |
| acrylate monomer 2 | 736 | — | — | — | 736 | — | — | — |
| Feldspar | 1120 | 1120 | 1120 | 1120 | — | — | — | — |
| photoinitiator | 22 | 16 | 12 | 12 | 22 | 16 | 12 | 12 |
| wetting agent | 5 | 5 | 5 | 5 | 5 | 5 | 5 | 5 |
| silicone antifoam | 1 | — | — | — | 1 | — | — | — |
| $SiO_2$ | 60 | 70 | 70 | 60 | 60 | 60 | 60 | 60 |
| acrylate monomer 3 | — | 1570 | 1177 | 785 | — | 1570 | 1177 | 785 |
| epoxy-functional material | — | 275 | 550 | 824 | — | 275 | 550 | 824 |
| Cyclic anhydride | — | 115 | 235 | 353 | — | 115 | 235 | 353 |
| catalyst 1 | — | 10 | 10 | 10 | — | — | — | — |
| Wollastonite | — | — | — | — | 1120 | 1120 | 1120 | 1120 |
| catalyst 2 | — | — | — | — | — | 10 | 10 | 10 |
| Premix Total | 3334 | 3181 | 3179 | 3169 | 3334 | 3171 | 3169 | 3169 |

TABLE 3

Premix and Abrasive Particles used in Examples 1–6 and Comparative Examples A–B

| Example | Premix Type | Abrasive Particles 1 (g) | Abrasive Particles 2 (g) |
|---|---|---|---|
| 1 | 2 | 2625 | 875 |
| 2 | 3 | 2625 | 875 |
| 3 | 4 | 2625 | 875 |
| 4 | 6 | 2625 | 875 |
| 5 | 7 | 2625 | 875 |
| 6 | 8 | 2625 | 875 |
| Comparative Example A | 1 | 2625 | 875 |
| Comparative Example B | 5 | 2625 | 875 |

TABLE 4

Process Conditions for Examples 1–6 and Comparative Examples A–B

| Example | Line speed m/min | Coater gap mm | Mandrel temp, ° C. | Binder precursor temp, ° C. | # lamps (power level) |
|---|---|---|---|---|---|
| 1 | 30.5 | 0.51 | 16 | 32 | one (400 Watts/in) |
| 2 | 24.4 | 0.51 | 16 | 32 | one (400 Watts/in) |
| 3 | 18.3 | 0.51 | 16 | 32 | one (400 Watts/in) |
| Comparative Example A | 15.2 | 0.51 | 49 | 32 | one (600 Watts/in) |
| 4 | 12.2 | 0.56 | 10 | 29 | one (600 Watts/in) |
| 5 | 9.1–12.2 | 0.56 | 21 | 32 | two (600 Watts/in) |

TABLE 4-continued

Process Conditions for Examples 1–6 and Comparative Examples A–B

| Example | Line speed m/min | Coater gap mm | Mandrel temp, ° C. | Binder precursor temp, ° C. | # lamps (power level) |
|---|---|---|---|---|---|
| 6 | 6.1 | 0.56 | 38 | 35 | two (600 Watts/in) |
| Comparative Example B | 6.1 | 0.56 | 38 | 34 | one (600 Watts/in) |

Examples 1–3 and Comparative Example A

Examples 1–3 and Comparative Example A demonstrate the efficacy of the present invention to make useful abrasive particles containing feldspar as a filler.

Example 1

Figure 10:
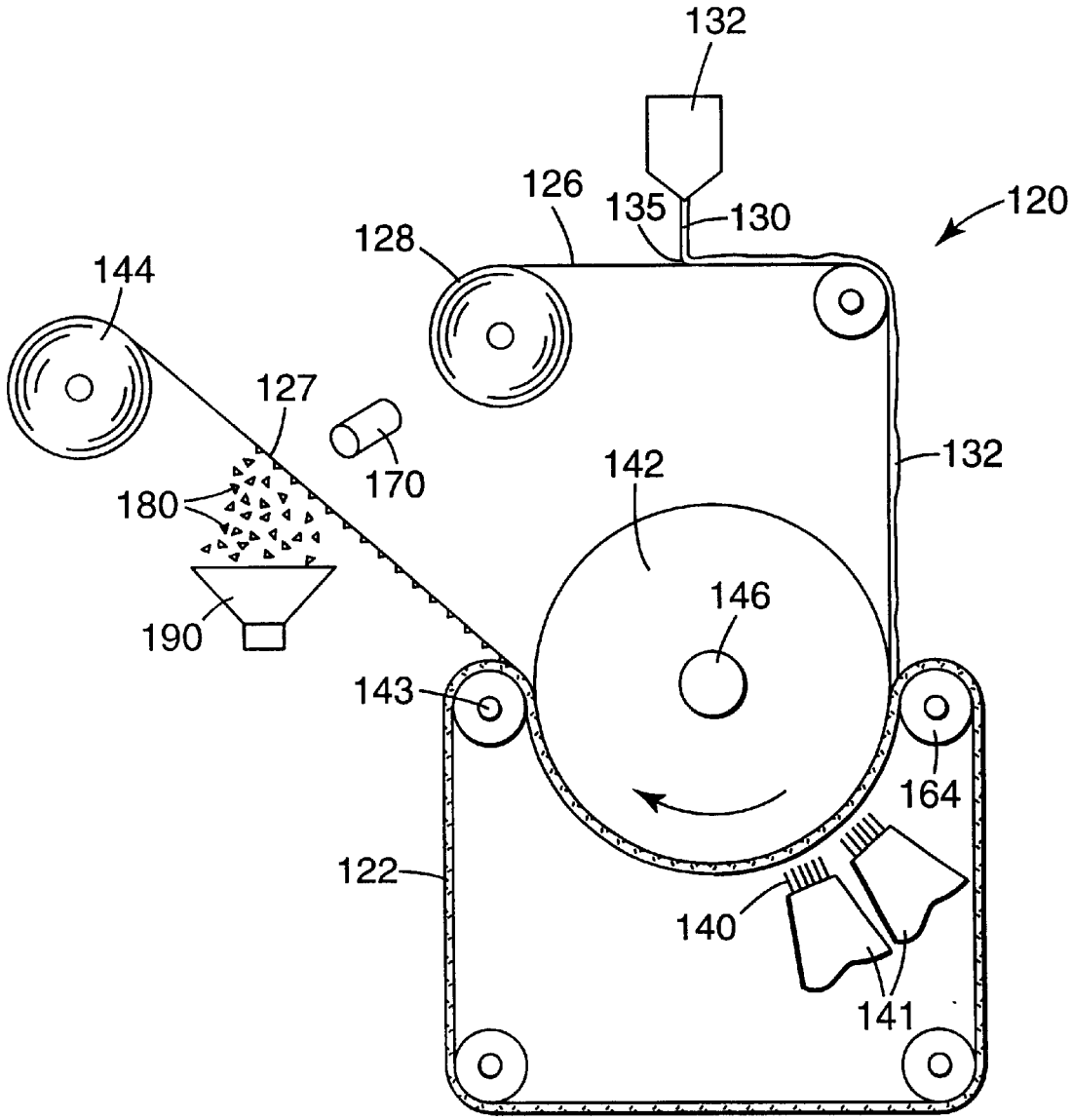
FIG. 10 is a schematic side view illustrating another method of making exemplary particles according to the present invention.

As illustrated in FIG. 10, binder particles 180 of Example 1 were prepared on apparatus 120. Apparatus 120 included production tool 122 in the form of an endless belt. Production tool 122 was made of a polymeric material that was substantially transparent to desired wavelength of actinic radiation. Production tool 122 and the process to make tool 122 are described in U.S. Pat. Nos. 5,435,816 (Spurgeon et al.) and 5,975,987 (Hoopman et al.). Binder particles 180 prepared were 533 micrometer (21 mil) high, four sided pyramids with 1371 micrometer (54 mil) bases made in production tool 122 which was formed using the knurling teachings of U.S. Pat. No. 5,975,987 (Hoopman et al.). Carrier web 126 was a 75 micrometer thick (3 mil) polyester film having a ethylene-acrylic acid primer coating. As carrier web 126 left unwind station 128, binder precursor 132 was applied by means of coater 130 onto carrier web 126. Binder precursor 132 included Premix 2 (as described in Table 2) to which was added a mixture of 2625 g of abrasive particles 1 and 875 grams abrasive particles 2. The portion of carrier web 126 containing binder precursor 132 was brought into contact with production tool 122 by means of nip roll 164. The portion of production tool 122 and carrier web 126 containing binder precursor 132 was forced against temperature controlled mandrel 142. Mandrel 142 was rotated about axis 146. Next, radiation energy 140 from radiation source 141 was transmitted through production tool 122 and into binder precursor 132. Radiation source 141 was a medium pressure mercury vapor ultraviolet lamp operating at 400 Watts/inch (160 Watts/cm). Upon exposure to radiation 140 from radiation source 141, binder precursor 132 was converted into solidified, handleable binder particles 180. Both production tool 122 and carrier web 126 containing solidified, handleable binder particles 180 were continuously moved past radiation source 141 by means of mandrel 142. Carrier web 126 containing binder particles 180 was separated from production tool 122 in the vicinity of nip roll 143. The back side 127 (i.e., the side containing no pyramid shaped particles) of carrier web 126 was then brought into contact with ultrasonic horn 170 (6-4 titanium construction driven with a 900 Watt, 184 volt Branson power source (Branson Ultrasonics Corp., Applied Technologies Group, Danbury, Conn.) coupled with a 2:1 Booster 802 piezoelectric converter) being oscillated at 91,100 Hz at an amplitude of about 130 micrometers such that binder particles 180 were caused to be released from carrier web 126 and be collected in hopper 190. Carrier web 126 was wound on winder station 144.

The process was continuous and operated at a web speed of 30.5 meters/minute. The coater gap 135 of coater 130 was 0.020 inches (0.51 mm), the temperature of mandrel 142 was maintained at 60° F. (15.6 C), and the temperature of binder precursor 132 was maintained at 90° F. (32° C.).

Examples 2 and 3 and Comparative Example A

The binder particles of Examples 2 and 3 and Comparative Example A were prepared according to the procedure of Example 1 with the respective compositions shown in Table 3. Process conditions are shown in Table 4.

Examples 4–6 and Comparative Example B

Examples 4–6 and Comparative Example B were prepared according to the procedure of Example 1 with the respective compositions shown in Table 3. Process conditions are shown in Table 4.

Examples 4–6 and Comparative Example B show the efficacy of the present invention when employed to manufacture abrasive particles having wollastonite as a filler. A thermal catalyst was substituted for the photocatalyst employed in Examples 1–3 and Comparative Example A. After separation from the carrier web, the particles of these examples were heated to 120° C. for 30 minutes to further advance the cure.

Preparation of Abrasive Articles

The particles of Examples 1–6 and Comparative Examples A–B were used to prepare abrasive articles for testing. Strips of abrasive articles measuring 10 cm (4 inches) wide by 111.76 cm (44 inches) long were prepared using the following general procedure. A conventional calcium carbonate filled phenolic resin make coat was applied with a die coater at a weight of approximately 0.0266 g/cm$^2$ onto a 350 g/m$^2$ phenolic/latex treated polyester cloth backing. Next, the particles were drop coated onto the make coat at a weight of approximately 0.0774 g/cm$^2$ to produce a closed coat. Phenolic resin was applied over the particles with a paint brush to provide a size coat. The approximate weight of the size coat is reported in each example. The abrasive belts were heated in a convection oven at 93° C. (200° F.) for 90 minutes, and then at 110° C. (230° F.) for 10 hours. After curing, the belts were cut to 96 cm by 2.5 cm and were spliced with a conventional butt splice.

Test Procedure

The abrasive belts were each tested separately on an ELB reciprocating bed grinding machine obtained from ELB Grinders Corp., Mountainside, N.J., under the trade designation ELB TYPE SPA 2030ND. The effective cutting area of the abrasive belt was 2.5 cm by 96 cm. The workpiece abraded by the belts was a 1018 steel workpiece having the dimensions 1.3 cm (width) by 35 cm (length) by 10 cm (height). Abrading was conducted along the 1.3 cm by 35 cm edge. The workpiece was mounted on a reciprocating table. The speed of the abrasive belt was 1676 meters/minute (5500 surface feet per minute). The table speed at which the workpiece traversed was 6.1 meters/minute (20 ft/min). The process used was conventional surface grinding wherein the workpiece was reciprocated beneath the rotating abrasive belt with incremental downfeeding of 12.7 micrometers (0.5 mil) per pass of the workpiece for Examples 1–3 and Comparative Example A. For Examples 4–6 and Comparative Example B, the downfeed was increased to 17.8 micrometers (0.7 mil) per pass of the workpiece. This grinding was carried out under a water feed of 22.8 liters/minute (6 gpm). The endpoint of the test was the point at which substantially all of the abrasive coating was worn off of the backing. The workpiece was weighed both at the beginning and at the end of the test. The difference in the weight of the workpiece was reported as "cut".

Test results from abrasive articles including the particles of Examples 1–6 and Comparative Examples A–B are shown in Table 5. These data show that abrasive belts made with particles containing binders from the invention outperform abrasive belts made with particles of the prior art in wet surface grinding.

TABLE 5

Abrading Test Results for Examples 1–6 and Comparative Examples A–B

| Particles | Size weight, g/m$^2$ | Cut, g. | Average cut, g. |
|---|---|---|---|
| Comparative Example A | 167 | 165, 152 | 158 |
| Comparative Example A | 251 | 124, 136 | 130 |
| Example 1 | 167 | 232, 231 | 231 |
| Example 1 | 251 | 275, 195 | 235 |
| Example 2 | 167 | 215, 184 | 200 |
| Example 2 | 251 | 211, 197 | 204 |
| Example 3 | 167 | 266, 256 | 261 |
| Example 3 | 251 | 263, 258 | 261 |
| Compararative Example B | 167 | 199, 237 | 217 |
| Compararative Example B | 251 | 222, 253 | 238 |
| Example 4 | 167 | 230, 154 | 192 |
| Example 4 | 251 | 211, 269 | 240 |
| Example 5 | 167 | 359, 500 | 430 |
| Example 5 | 334 | 392, 437 | 414 |
| Example 6 | 167 | 391, 403 | 397 |
| Example 6 | 251 | 458, 382 | 420 |

Examples 7–10

Examples 7–10 were prepared to demonstrate the improvement in fracture toughness of the inventive composite particles when compared to those previously known. Molded articles were prepared by the following procedure.

The compositions of Examples 7–10 are shown in Table 6. Test specimens for measuring fracture toughness were prepared by separately degassing the compositions under vacuum and pouring the various compositions into 0.25×1.5×3 inch (6.35×38.1×76.2 mm) molds having quartz glass plates on the top and bottom. Each composition was then cured by exposure to UV radiation (D bulb, Fusion UV Systems Incorporated, Gaithersburg, Md.) sequentially from both top and bottom at the following power levels and conveyor speeds: Examples 7–10 were all exposed by the following four step procedure: (1) 70 ft/min (21.3 m/min), both sides, 400 watts/in lamp power level; (2) 70 ft/min (21.3 m/min), both sides, 600 watts/in lamp power level; (3) 50 ft/min (15.2 m/min), both sides, 600 watts/in lamp power level; and (4) 25 ft/min (7.6 m/min), both sides, 600 watts/in lamp power level. This slow cure was used to prevent defects in curing thick test pieces. Following UV exposure, all molded specimens were thermally cured at 100° C., 120° C., and 140° C. for a one hour period at each temperature. The cured test specimens were then de-molded for $K_{IC}$ (Mode I Critical Stress Intensity Factor) Fracture Toughness testing (ASTM E399-90 (1997)), using specimen configuration Compact Tension, C(T). Average test values for each composition are shown in Table 6, wherein higher $K_{IC}$ values indicate increased toughness.

TABLE 6

Formulations used in Examples 7–10

| Component | Example 7 | Example 8 | Example 9 | Example 10 |
|---|---|---|---|---|
| Acrylic monomer 3 | 11.9 | 23.8 | 35.6 | 47.5 |
| Photoinitiator | 0.1 | 0.2 | 0.4 | 0.5 |
| epoxy-functional material | 33.6 | 25.2 | 16.8 | 8.4 |
| Hexahydrophthalic anhydride | 14.4 | 10.8 | 7.2 | 3.6 |
| Catalyst 2 | 0.6 | 0.6 | 0.6 | 0.6 |
| Wollastonite | 40 | 40 | 40 | 40 |
| Average $k_{ic}$, mpa√m | 1.57 | 1.39 | 1.12 | 0.87 |

The complete disclosure of all patents, patent applications, and publications, and electronically available material cited herein are incorporated by reference. The foregoing detailed description and examples have been given for clarity of understanding only. No unnecessary limitations are to be understood therefrom. The invention is not limited to the exact details shown and described, for variations obvious to one skilled in the art will be included within the invention defined by the claims.

What is claimed is:

1. A discrete particle comprising a polymeric material and a plurality of abrasive grits, wherein the polymeric material comprises a reaction product of components comprising (a) an epoxy-functional material, and (b) at least one of a non-polymeric cyclic anhydride or a diacid derived therefrom.

2. The particle of claim 1 wherein the components further comprise (c) a curing agent.

3. The particle of claim 1 wherein the components further comprise (c) a polyfunctional (meth)acrylate.

4. The particle of claim 3 wherein the polyfunctional (meth)acrylate is a monomer, an oligomer, or a polymer.

5. The particle of claim 3 wherein the components further comprise (d) a free radical initiator.

6. A discrete particle comprising a plurality of abrasive grits and a polymeric material preparable by combining components comprising at least (a) an epoxy-functional material, and (b) at least one of a non-polymeric cyclic anhydride or a diacid derived therefrom.

7. The particle of claim 6 wherein the components further comprise (c) a curing agent.

8. The particle of claim 6 wherein the components further comprise (c) a polyfunctional (meth)acrylate.

9. The particle of claim 8 wherein the polyfunctional (meth)acrylate is a monomer, an oligomer, or a polymer.

10. The particle of claim 8 wherein the components further comprise (d) a free radical initiator.

11. An abrasive article comprising a plurality of discrete particles that comprise a polymeric material comprising a reaction product of components comprising (a) an epoxy-functional material, and (b) at least one of a non-polymeric cyclic anhydride or a diacid derived therefrom.

12. The article of claim 11 wherein at least a portion of the particles further comprise a plurality of abrasive grits.

13. The article of claim 11 wherein the components further comprise (c) a curing agent.

14. The article of claim 11 further comprising a backing attached to at least a portion of the particles.

15. The article of claim 11 further comprising a nonwoven web having attached thereto at least a portion of the particles.

16. The article of claim 11 wherein the components further comprise (c) a polyfunctional (meth)acrylate.

17. The article of claim 16 wherein the polyfunctional (meth)acrylate is a monomer, an oligomer, or a polymer.

18. The article of claim 16 wherein the components further comprise (d) a free radical initiator.

19. An abrasive article comprising a plurality of particles comprising a polymeric material preparable by combining components comprising at least (a) an epoxy-functional material, and (b) at least one of a non-polymeric cyclic anhydride or a diacid derived therefrom.

20. The article of claim 19 wherein at least a portion of the particles further comprise a plurality of abrasive grits.

21. The article of claim 19 wherein the components further comprise (c) a curing agent.

22. The article of claim 19 further comprising a backing attached to at least a portion of the particles.

23. The article of claim 19 wherein the components further comprise (c) a polyfunctional (meth)acrylate.

24. The article of claim 23 wherein the polyfunctional (meth)acrylate is a monomer, an oligomer, or a polymer.

25. The article of claim 23 wherein the components further comprise (d) a free radical initiator.

26. A method of preparing a discrete particle comprising:

combining components comprising at least (a) an epoxy-functional material, (b) at least one of a non-polymeric cyclic anhydride or a diacid derived therefrom, and (c) a plurality of abrasive grits to provide a composition; and at least partially curing at least a portion of the composition to provide a discrete particle.

27. The method of claim 26 wherein the components further comprise (d) a curing agent.

28. The method of claim 26 wherein the components further comprise (d) a polyfunctional (meth)acrylate.

29. The method of claim 28 wherein the components further comprise (e) a free radical initiator.

30. The method of claim 26 wherein at least partially curing at least a portion of the composition comprises irradiating at least a portion of the composition.

31. The method of claim 26 wherein at least partially curing at least a portion of the composition comprises thermally curing at least a portion of the composition.

32. The method of claim 26 further comprising:

providing a production tool having a three-dimensional body with one or more cavities in the three-dimensional body; and introducing the composition into at least a portion of the one or more cavities.

33. The method of claim 32 wherein at least partially curing at least a portion of the composition comprises partially curing at least a portion of the composition in at least a portion of the one or more cavities of the production tool.

34. The method of claim 32 further comprising removing the discrete particle from the cavity.

* * * * *